US007766718B2

(12) United States Patent
Rago et al.

(10) Patent No.: US 7,766,718 B2
(45) Date of Patent: Aug. 3, 2010

(54) ROTATABLE FLEXIBLE DISK TOYS

(75) Inventors: Paul S. Rago, Danville, CA (US); Russell G. Rasmussen, Petaluma, CA (US); Virginia M. Bala, Petaluma, CA (US); William J. Hudson, Pleasanton, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 693 days.

(21) Appl. No.: 11/465,410

(22) Filed: Aug. 17, 2006

(65) Prior Publication Data

US 2007/0281581 A1 Dec. 6, 2007

Related U.S. Application Data

(60) Provisional application No. 60/811,483, filed on Jun. 6, 2006.

(51) Int. Cl.
*A63H 1/24* (2006.01)
*A63H 33/22* (2006.01)
*A63H 33/26* (2006.01)

(52) U.S. Cl. ..... 446/242; 446/485

(58) Field of Classification Search ..... 15/34, 15/52, 72; 446/242, 243, 244, 484, 485
See application file for complete search history.

(56) References Cited

U.S. PATENT DOCUMENTS 150,869 A 5/1874 Lillibridge
1,475,074 A * 11/1923 McLaughlin ..... 15/179
2,027,863 A * 1/1936 Hall ..... 15/230.1
2,061,940 A * 11/1936 Hargy, Sr. ..... 15/230.14
2,098,168 A 11/1937 Sperry
2,146,284 A * 2/1939 Churchill ..... 15/230.1
2,318,016 A * 5/1943 Schlegel ..... 15/225
3,037,322 A 6/1962 Baumgartner, Jr.
3,964,189 A 6/1976 Belokin, Jr.
4,097,917 A 6/1978 McCaslin
4,304,064 A 12/1981 Kulesza et al.
4,435,917 A 3/1984 Lee
4,552,542 A 11/1985 Reysman
4,852,283 A 8/1989 Teng
5,138,735 A * 8/1992 Kusz et al. ..... 15/97.1
5,190,491 A * 3/1993 Connelly ..... 446/242
5,190,620 A * 3/1993 Winter ..... 156/344
5,269,874 A * 12/1993 Winter ..... 156/584
5,310,377 A 5/1994 Joja (Continued)

OTHER PUBLICATIONS

Electrical Slip Ring Assemblies, www.uea-inc.com, © 2002-2004, 2 pages.

(Continued)

*Primary Examiner*—John Ricci
(74) *Attorney, Agent, or Firm*—Blakely Sokoloff Taylor & Zafman LLP

(57) ABSTRACT

In one embodiment of the invention, a spinning or rotatable flexible disk toy is disclosed. The spinning or rotatable flexible disk toy includes a hand-held housing, an electric motor, a switch, and a flexible disk. The electric motor is mounted in the hand-held housing and has a rotatable shaft. The switch is mounted in the hand-held housing and electrically coupled to the electric motor to selectively provide power to the electric motor. The flexible disk is coupled to the rotatable shaft of the electric motor.

31 Claims, 16 Drawing Sheets

U.S. PATENT DOCUMENTS

| | | | | |
|---|---|---|---|---|
| 5,453,036 | A | 9/1995 | Wisznia | |
| 5,863,235 | A | 1/1999 | Bendik, Jr. et al. | |
| 5,902,166 | A | 5/1999 | Robb | |
| 6,018,899 | A | 2/2000 | Hanitz | |
| 6,171,170 | B1 | 1/2001 | Lin | |
| 6,183,336 | B1 | 2/2001 | Coleman et al. | |
| 6,227,929 | B1 | 5/2001 | Nelson et al. | |
| 6,575,585 | B2 * | 6/2003 | Nelson et al. | 362/35 |
| 6,592,423 | B1 | 7/2003 | Boyle et al. | |
| 6,604,742 | B2 | 8/2003 | El Sabbagh | |
| 6,640,377 | B2 * | 11/2003 | Krause et al. | 15/230 |
| 6,769,951 | B2 | 8/2004 | Collier | |
| 6,789,287 | B2 * | 9/2004 | Calabrese | 15/97.1 |
| 6,802,758 | B2 | 10/2004 | Somers | |
| 7,179,149 | B2 * | 2/2007 | Chernick et al. | 446/242 |

OTHER PUBLICATIONS

Slip Rings, How a Slip Ring Works, www.uea-inc.com, © 2002-2004, 2 pages.

How does a slip ring work? www.mercotac.com/html/slip-ring.html, 1 page.

Hand Held Spinner Disk (Each), Rebecca's Online Catalog website, © 2005, 2 pages.

Beam Team Jack Hammer Rescue Hero, Fisher-Price, www.rescueheroes.com, undated, 1 page.

* cited by examiner

FIG. 3A
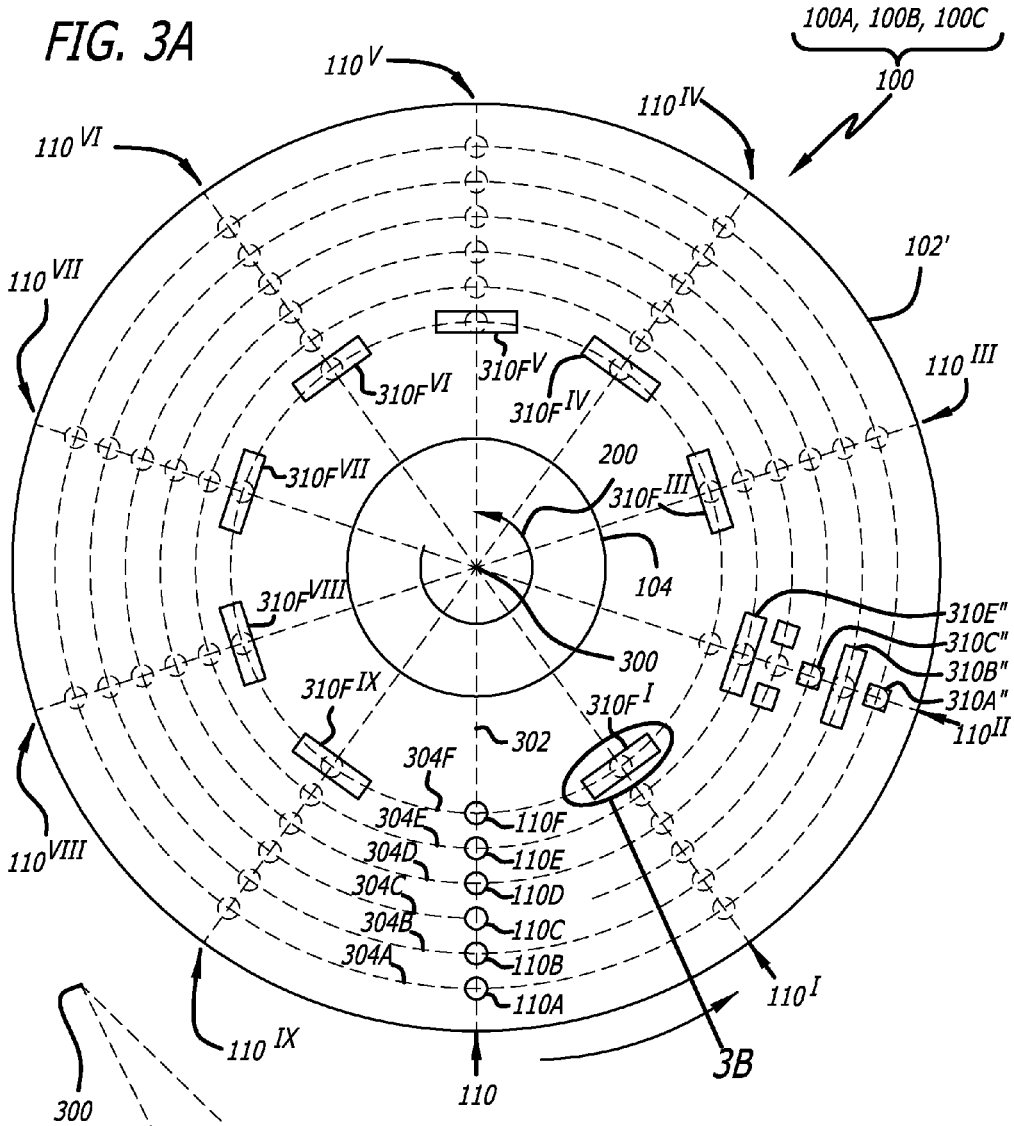
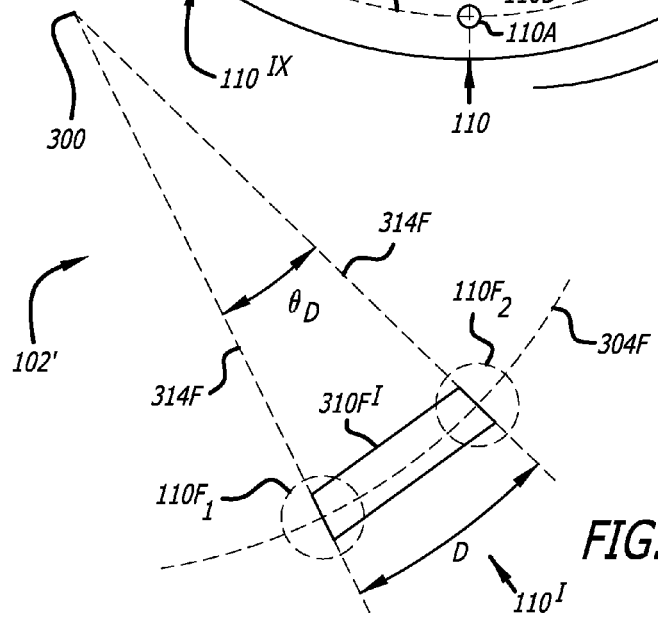
FIG. 3B

ROTATABLE FLEXIBLE DISK TOYS

CROSS-REFERENCE TO RELATED APPLICATIONS

This non-provisional United States (U.S.) patent application claims the benefit of U.S. Provisional Patent Application No. 60/811,483 filed on Jun. 6, 2006 by inventors Paul Rago et al, entitled ROTATABLE FLEXIBLE DISK TOYS WITH LIGHTING.

FIELD

The embodiments of the invention relate generally to spinning toys. More particularly, the embodiments of the invention relate to spinning light toys.

BACKGROUND

The patent literature includes examples of toys arranged to be spun and/or illuminated to provide an aesthetically pleasing appearance to amuse a user.

Additionally, various illuminated spinning toys are commercially available. For example, one toy company sells an illuminated spinning toy which is a hand-held device including a handle assembly supporting a rotatable hub. Projecting outward from the hub are plural flexible arms, each one terminating in a light source or lamp. The hub is arranged to be rotated at a high rate of speed by an electric motor receiving power from a battery pack. The battery pack and the motor are located in the handle assembly. The handle assembly includes a depressable button or trigger, which when depressed enables electric power from the battery pack to be provided to the motor, whereupon the motor operates to rapidly spin the arms and cause them to extend radially outward from the hub. The lights in the arms are arranged to receive power from the battery pack when the trigger is depressed, whereupon they illuminate as they spin, creating a highly attractive visual effect.

BRIEF SUMMARY

The embodiments of the invention are summarized by the claims that follow below.

BRIEF DESCRIPTIONS OF THE DRAWINGS

FIG. 3A is a top view of embodiments of the rotatable flexible disk toy with lighting that is powered on with the rotatable flexible disk spinning.

FIG. 3B is a magnified view of a portion of the top view illustrated in FIG. 3A.

DETAILED DESCRIPTION

In the following detailed description of the embodiments of the invention, numerous specific details are set forth in order to provide a thorough understanding of the present invention. However, it will be obvious to one skilled in the art that the embodiments of the invention may be practiced without these specific details. In other instances well known methods, procedures, components, and circuits have not been described in detail so as not to unnecessarily obscure aspects of the embodiments of the invention.

The embodiments of the invention include methods and apparatus for a rotatable flexible disk toy. In some embodiments of the invention, the rotatable flexible disk toy includes lighting to generate a light pattern around the rotatable flexible disk. In which case, the rotatable flexible disk toy may be referred to as a spinning flexible disk light toy.

Figure 1:
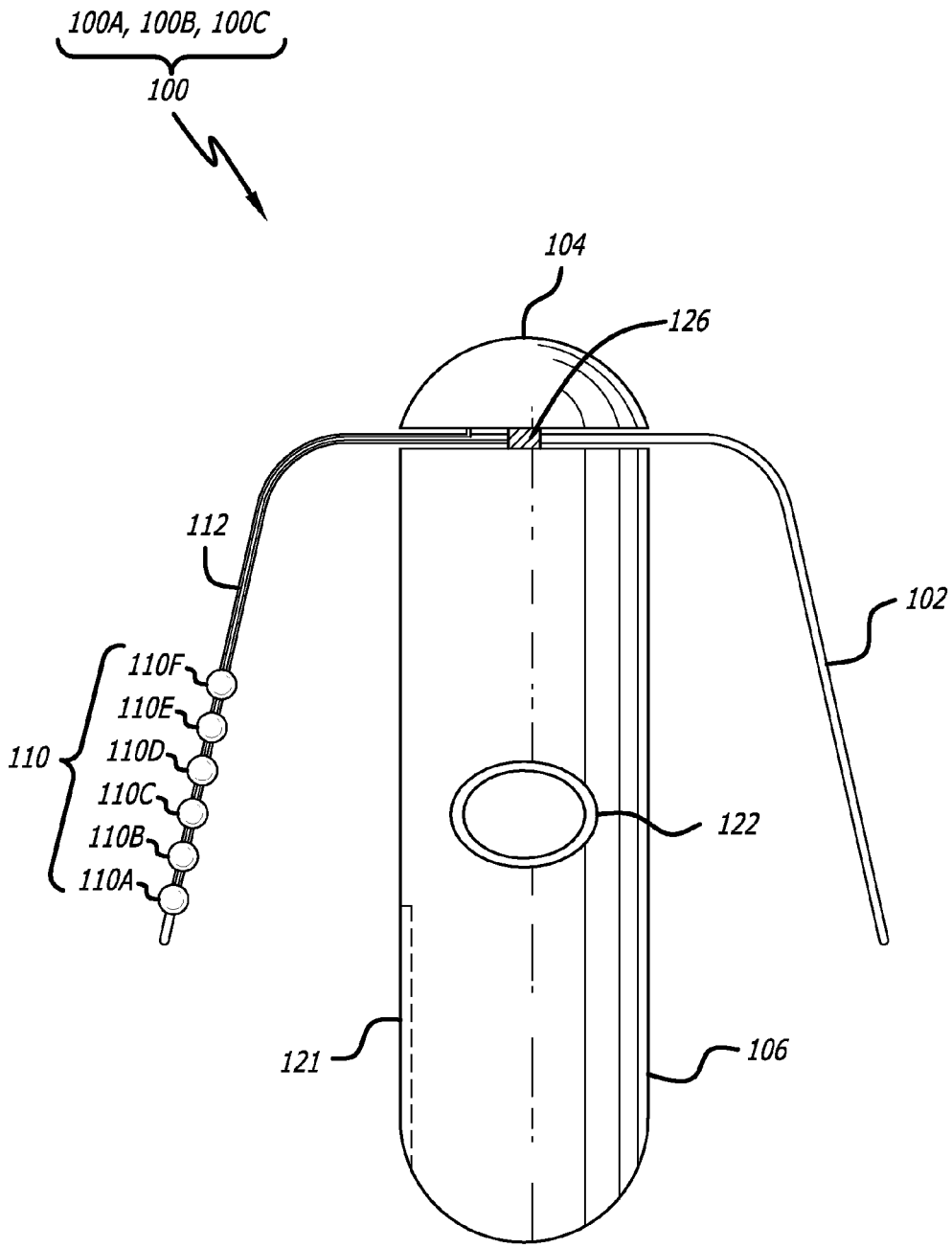
FIG. 1 illustrates a side view of embodiments of the rotatable flexible disk toy with lighting.

Referring now to FIG. 1, a side view of a rotatable flexible disk toy 100 is illustrated with the flexible disk 102 being cross-sectioned to avoid obscuring other aspects of the toy. FIG. 3A illustrates a top view while FIGS. 6 and 7A-7C illustrate perspective views of the rotatable flexible disk toy 100 in different conditions. The rotatable flexible disk toy 100 is the general reference to the embodiments of the rotatable flexible disk toys 100A, 100B, 100C that include lighting effects.

The rotatable flexible disk toy 100 includes lighting that may be generated by one or more lights 110. In a preferred embodiment, the lights 110 are lighting emitting diodes (LEDs) 110 and may be referenced herein interchangeably. The one or more lighting emitting diodes (LEDs) 110 may be selected to generate different wavelengths of light or colors. For example, LED 110A may be yellow in color while LED 110F is red in color.

The rotatable flexible disk toy 100 further includes a rotatable housing 104, a flexible disk 102, a hand-held housing 106 and a rotatable shaft 126. The flexible disk 102 is coupled to the rotatable shaft 126 as is the rotatable housing 104. That is, the flexible disk 102 and the rotatable housing 104 are coupled together and to the rotatable shaft 126. The rotatable housing 104 has a center portion coupled to the rotatable shaft 126 of the electric motor 124. The shaft 126 is coupled between the hand-held housing 106 and the rotatable elements, the flexible disk 102 and the rotatable housing 104, of the rotatable flexible disk toy 100. In one or more embodiments of the invention, the rotatable housing 104 is dome-shaped and may be hollow to accommodate components therein.

The one or more lighting emitting diodes 110 of the rotatable flexible disk toy 100 are mounted to the flexible disk 102. A plurality of wires or cables 112 are mounted to the flexible disk 102 and coupled to the one or more LEDs 110 at one end to couple signals to the LEDs to control the lighting generated by the rotatable flexible disk toy 100. Thus, the wires or cables 112 and the LEDs 110 spin with the flexible disk 102.

The flexible disk 102 can be formed out of any kind of flexible fabric or textile including low durometer polyvinylchloride (PVC) or plastic, nylon, etc. For example, the flexible disk 102 may be a flexible disk-like shaped fabric or a flexible disk-like shaped plastic. Two halves of a disk-like shaped flexible fabric or textile may be sewn together to from the flexible disk 102. The flexible fabric or textile is formed into the shape of a circular disk or a flat ring with a center opening, such as a washer. In either case, the flexible fabric is referred to herein as being a flexible disk because any center opening is not visible when the toy is assembled. In one embodiment of the invention, the one or more lighting emitting diodes 110 are sewn into flexible disk shaped material and the plurality of wires or cables 112 are sewn into one or more pockets in the flexible disk shaped material to form the flexible disk 102.

The hand held housing 106 has a hollow cylindrical-like shape so as to be holdable or graspable by a user's hand. The hand-held housing 106 includes a momentary push button switch 122 and a battery door 121. The battery door 121 is detachable to allow one or more batteries to be inserted into the hand held housing 106 to provide power to the rotatable flexible disk toy 100. The switch 122 allows a user to turn on the rotatable flexible disk toy 100 and cause the flexible disk 102 to spin and the one or more lights 110 to periodically turn on and off. In a preferred embodiment of the invention, the switch 122 is a push button switch. Alternatively, the switch 122 may be a sliding switch or a rotary switch.

In FIG. 1, the flexible disk 102 is in a limp condition as it is not spinning. If it is not spinning, gravity is allowed to pull down on the flexible disk 102 so that it droops from the rotatable housing 104 towards ground. If the flexible disk 102 is spun by the shaft 126, it becomes stretched out by centrifugal force into a stretched condition so that is no longer limp. The limp condition may also be referred to as a non-spinning condition. The stretched condition may also be referred to as a spinning condition.

The rotatable flexible disk toy 100 may be assembled in different ways and use different components. Some of the components may be placed in the rotatable housing 104 while others may be placed in the hand-held housing 106. For example, it may be desirable to place the LED control electronics in the rotatable housing 104 to reduce the number of rotating electrical connections and to reduce the number of control signals that may experience noise. On the other hand, it may be desirable to eliminate all rotating electrical connections and have a first set of one or more batteries in the rotatable housing 104 to provided power to control and light the LEDs while a second set of one or more batteries may be provided in the hand held housing 106 to power an electric motor to spin the rotatable housing 104 and the flexible disk 102. Various embodiments are described below that have elements that can be interchanged with each to form additional embodiments of the invention.

Figure 2:
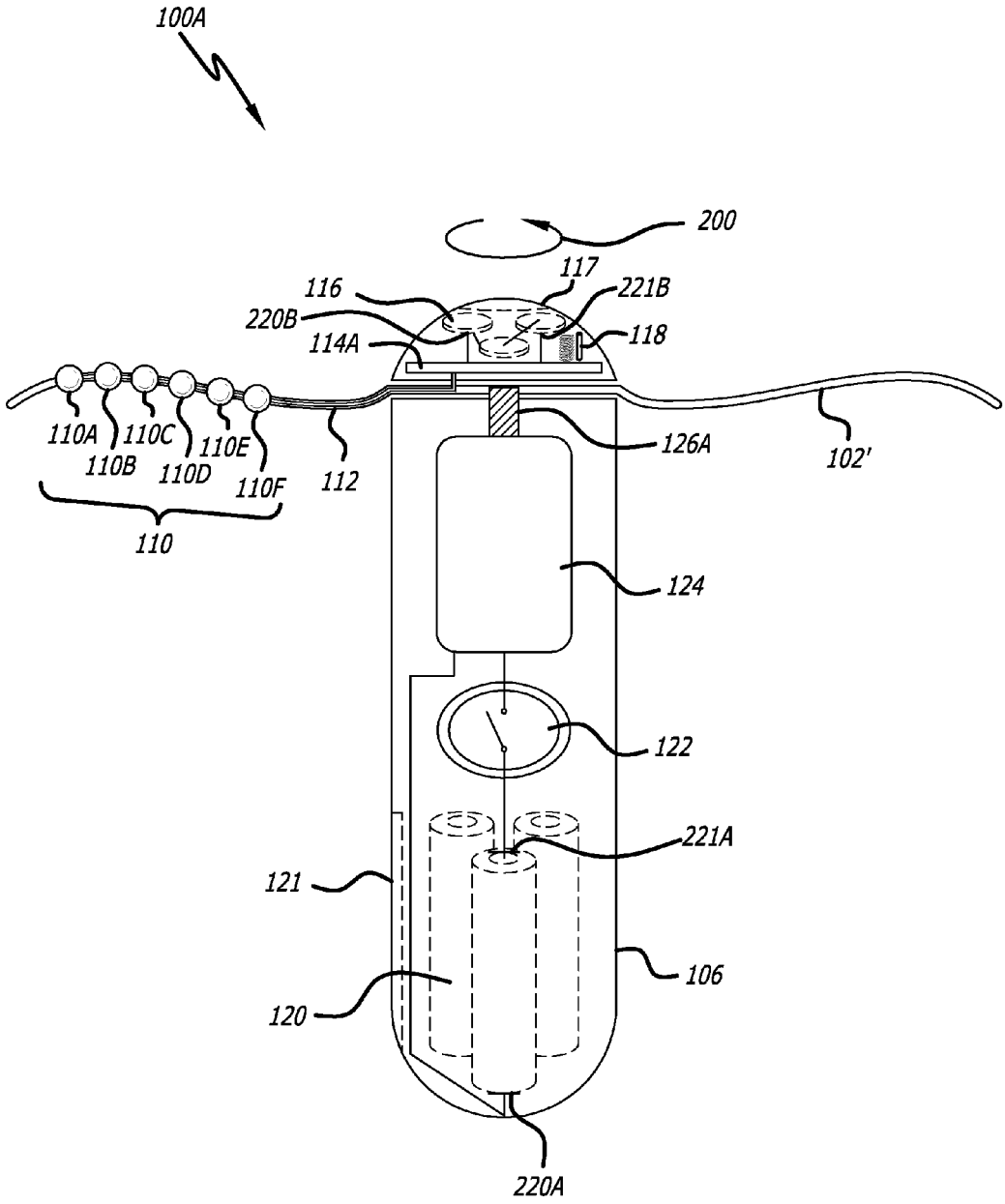
FIG. 2 is a cross-sectional view of one embodiment of the rotatable flexible disk toy with lighting that is powered on with the rotatable flexible disk spinning.

Referring now to FIG. 2, a cut-away view of a rotatable flexible disk toy 100A is illustrated. The rotatable flexible disk toy 100A is one embodiment of the invention. The rotatable flexible disk toy 100A includes lighting and is depicted as being powered on with the flexible disk 102 spinning into stretched flexible disk 102' as indicated by the rotating arrow 200 near an axis of rotation 203 that is concentric to the shaft 126A. In this case with the flexible disk 102 spinning, the stretched flexible disk 102' is somewhat planarized when the hand held housing 106 is stationary and perpendicular to the horizon. The stretched flexible disk 102' in this case is somewhat perpendicular to the axis of rotation 203.

The rotatable flexible disk toy 100A receives one or more batteries 120 in the hand-held housing 106 to power an electric motor 124 and a separate set of one or more batteries 116 in the rotatable housing 104A to power a light controller or processor coupled to a printed circuit board 114A and the light emitting diodes 110. The one or more batteries 116 to be received in the rotatable housing 104A are preferably button cell batteries to reduce the weight being rotated. With the light controller and one or more batteries 116 in the rotatable housing, there is little need for a rotatable electrical connector between the hand held housing 106 and the rotatable housing 104A. The one or more batteries 120 in the hand-held housing 106 need only power the electronic circuit with the electric motor 124. The one or more batteries 120 may be formed as part of a battery pack.

The rotatable flexible disk toy 100A includes a first switch 122, the battery door 121, a first pair of power supply terminals 220A-221A, and an electric motor 124 mounted within the housing 106. The electric motor 124 includes a rotatable shaft 126A. An end of the rotatable shaft 126A couples to the flexible disk 102 and the rotatable dome shape housing 104A.

The first switch 122 is coupled between a first power supply terminal 221A and a first terminal of the motor 124. The second power supply terminal 220A is coupled to a second terminal of the motor 124. With the first switch 122 closed, a circuit is completed to provide power to the electric motor 124 to turn it on and rotate the rotatable shaft 126A. Opening the first switch 122 the circuit is opened and turns off the electric motor 124 so that the shaft is not rotated. In one embodiment of the invention, the first switch 122 is a push button switch that can be momentarily closed to couple a pair of switch terminals together.

Mounted within the rotatable housing 104A, the rotatable flexible disk toy 100A further includes a second pair of pair of power supply terminals 220B-221B, a second switch 118, and a light controller (see light controller 801A of FIG. 8A) coupled to a printed circuit board 114A. The second switch 118 may be a centrifugal switch to sense rotation of the rotatable housing 104A in one embodiment of the invention. In response to the second switch, the light controller coupled to the printed circuit board 114A controls the one or more light emitting diodes 110 by turning them on and off.

The second pair of pair of power supply terminals 220B-221B in the rotatable housing are to receive the one or more batteries 116. To gain access to the batteries 116, the rotatable housing 104A includes a battery door 117.

The second switch 118 may switch power from the one or more batteries 116 into the printed circuit board 114A to power on the light controller 801A so that it can turn on and off the light emitting diodes 110 in a controlled manner. A first pole of the switch 118 couples to one of the power supply terminals 220B-221B while a second pole couples to the light controller. Alternatively, the light controller 801A may couple to the power supply terminals 220B-221B to receive power from the one or more batteries 116 and the second switch 118 may generate a signal that is coupled into the light controller to control the lighting of the one or more LEDs 110. In the case where the second switch 118 is a centrifugal switch, the switch closes when the rotatable housing 104A spins to signal to or couple power into the light controller.

The wire cables 112 in the flexible disk 102' couple the light emitting diodes 110A-110N to traces on the printed circuit board 114A to couple to the light controller 801A. In one embodiment of the invention, one wire cable is ground that is commonly shared with a terminal of each light emitting diode 110A-110N. The wire cables 112 and the light emitting diodes 110 spin with the rotatable housing 104A and the flexible disk 102.

Referring now to FIG. 3A, a top view of the rotatable flexible disk toy 100 is illustrated. The flexible disk 102 of the rotatable flexible disk toy 100 is in a stretched condition (designated by the reference number 102') due to the centrifugal force that is generated by spinning it. The flexible disk 102' is somewhat planarized when the hand held housing 106 is stationary and perpendicular to the horizon. That is, because the flexible disk 102' is spinning it is not in the limp condition as it is when not rotating.

In one embodiment of the invention, the light emitting diodes 110 are located along one radius line 302 from the center 300. This eases the installation of the cables 112 in the flexible disk 102 and allows a single ground cable to be shared by each diode. In another embodiment of the invention, the light emitting diodes 110 are located along a plurality of radius lines and may include a change in lighting control responsive to the different positions of the LEDs 110.

The center 300 defines the axis of rotation of the rotatable flexible disk toy 100. The rotatable dome shape housing 104 and the flexible disk 102 rotate about the center 300 in either a clockwise rotation or a counter clockwise rotation depending upon how the electric motor 124 is controlled. The counter clockwise rotation is illustrated by the arrow 200 in FIG. 3A.

The lighting control of the LEDs 110 can take advantage of the persistence of vision in humans. Persistence of vision is a perceptual process of the brain and/or the retina of the human eye to retain an image for a brief moment. A visual form of memory is known as iconic memory. Iconic memory may be the cause of persistence of vision. Instead of perceiving individual frames in a series, persistence of vision may account for the illusion of motion which results when a series of film images are displayed in quick succession.

As the flexible disk 102 is rotated, one or more of the LEDs 110 may be turned on periodically for a period of time over an angular distance theta-D ($\theta_D$), such as six to ten degrees for example, to generate a pattern. For example, LED 110F may be turned on for a constant or variable period of time periodically around the circumference of circle 304F near LED positions $\mathbf{110}^{I}$, $\mathbf{110}^{III}$, $\mathbf{110}^{IV}$, $\mathbf{110}^{V}$, $\mathbf{110}^{VI}$, $\mathbf{110}^{VII}$, $\mathbf{110}^{VIII}$, and $\mathbf{110}^{IX}$ but not LED positions 110 and $\mathbf{110}^{II}$. The LED 110F is turned on and rotated with the flexible disk 102 to generate light over the angular distances $\mathbf{301}F^{I}$, $\mathbf{301}F^{III}$, $\mathbf{301}F^{IV}$, $\mathbf{301}F^{V}$, $\mathbf{301}F^{VI}$, $\mathbf{301}F^{VII}$, $\mathbf{301}F^{VIII}$, and $\mathbf{301}F^{IX}$.

FIG. 3B, illustrates a magnified view of the light generated over the angular distance $\mathbf{301}F^{I}$ by the LED 110F around the circle 304F. The LED 110F is turned on for a period of time as the flexible disk 102' is rotated through the angle theta-D or the arctuate distance D. As the flexible disk 102' is further rotated with the LED 110F, the persistence of vision in humans can retain the perception of light generated by the LED 110F over the angular distance 301F'.

With the flexible disk 102 spinning, a human user can perceive that a desired light pattern has been generated around a complete circumference of circle 304F in the flexible disk 102 due to persistence of vision. The angular velocity (RPM) of the flexible disk 102 may be varied to obtain differing lighting effects to amuse a user.

Figure 4A:
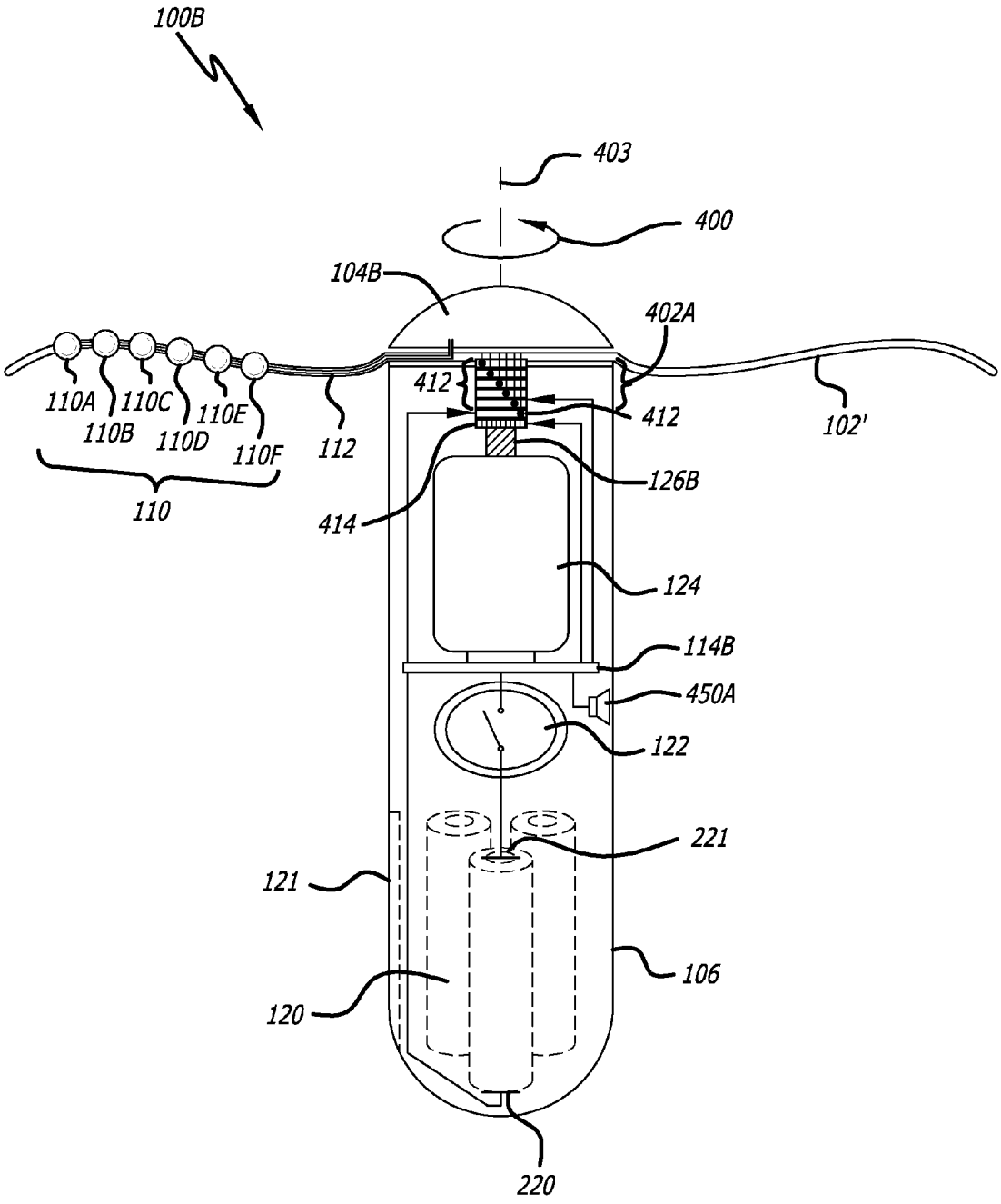
FIG. 4A is a cross-sectional view of another embodiment of the rotatable flexible disk toy with lighting.

Referring now to FIG. 4A, a cut away view of a rotatable flexible disk toy 100B is illustrated. The rotatable flexible disk toy 100B differs from the rotatable flexible disk toy 100A in that substantially all of the electronics are in the hand-held housing 106, but for the LEDs 110. The rotatable flexible disk toy 100B includes a rotatable electrical connection 402A that is utilized to couple ground and the control signals used to power on the LEDs 110 from the hand-held housing 106 to the rotatable housing 104B.

In one embodiment of the invention, the rotatable electrical connection 402A includes a plurality of slip rings 412—one slip ring for ground and one slip ring for each of the one or more light emitting diodes 110. For the exemplary seven LEDs 110A-110F illustrated in the Figures, there would be a total of eight slip rings 412 in the rotatable electrical connection 402A. The rotatable electrical connection 402A may further include a rotary encoder 414 that may provide an indication of one rotation of the flexible disk 102 (referred to as a "once-around" encoder) or a finer resolution of angular rotation, such as every ten degrees of rotation over each three hundred sixty degrees or finer still generating a signal every single degree of rotation over each three hundred sixty degrees of rotation. The rotary encoder may be used to provide angular position information and/or angular velocity information, such as the number of rotations per minute.

In an alternate embodiment of the invention, the rotatable electrical connection 402A is one slip ring for ground and one or more commutators. The one or more commutators may have differing arcuate surfaces that are used to control the lighting of the one or more LEDs 110 in a fixed pattern, without the use of a light controller, as the rotational housing 104B is rotated.

The rotatable flexible disk toy 100B further includes a printed circuit board 114B with a light controller that is mounted in the hand held housing 106 to control the lighting of the one or more light emitting diodes 110 through the plurality of slip rings 412. Additionally, the rotatable flexible disk toy 100B includes the switch 122, the battery door 121, a pair of power supply terminals 220-221, and the electric motor 124 mounted within the housing 106. The electric motor 124 includes the rotatable shaft 126B. An end of the rotatable shaft 126B couples to the flexible disk 102 and the rotatable housing 104B.

A first pole of the switch 122 is coupled to the first power supply terminal 221. A second pole of the switch is coupled to the printed circuit board (PCB) 114B and to a first terminal of the motor 124 by a first trace of the PCB 114B to supply power thereto. The second power supply terminal 220 is coupled to the printed circuit board 114B and to a second terminal of the motor 124 through a second trace of the printed circuit board. With batteries properly coupled to the power supply terminals 220-221 and the switch 122 closed, a circuit is completed to provide power to the electric motor 124 to turn it on and rotate the rotatable shaft 126B. Opening the switch 122 the circuit is opened and turns off the electric motor 124 so that the shaft is not rotated. In one embodiment of the invention, the switch 122 is a push button switch.

The rotatable flexible disk toy 100B further includes a rotatable housing 104B that is coupled to the flexible disk 102' and the rotatable shaft 126B. The shaft 126B, the rotatable housing 104B, and the flexible disk 102' rotate about an axis 403 as illustrated by the arrow 400. The rotatable housing 104B is simplified from that of the rotatable housing 104A in that no electronic components need be mounted therein. The rotatable housing 104B need not be hollow and may instead be a solid body. In one embodiment of the invention, the rotatable housing 104B is dome-shaped.

To provide further amusement to a user, the rotatable flexible disk toy 100B may further include one or more speakers 450A mounted in the hand held housing 106. As the rotatable housing 104B and the flexible disk 102' rotate, the one or more speakers 450A may provide sound effects, music, or other sounds with or without the light pattern generated by the LEDs 110. The speaker 450A couples to the printed circuit board 114B to receive electrical sound signals. An amplifier in the light controller may drive the sound signals to the speaker where they are transduced into sound waves.

Figure 4B:
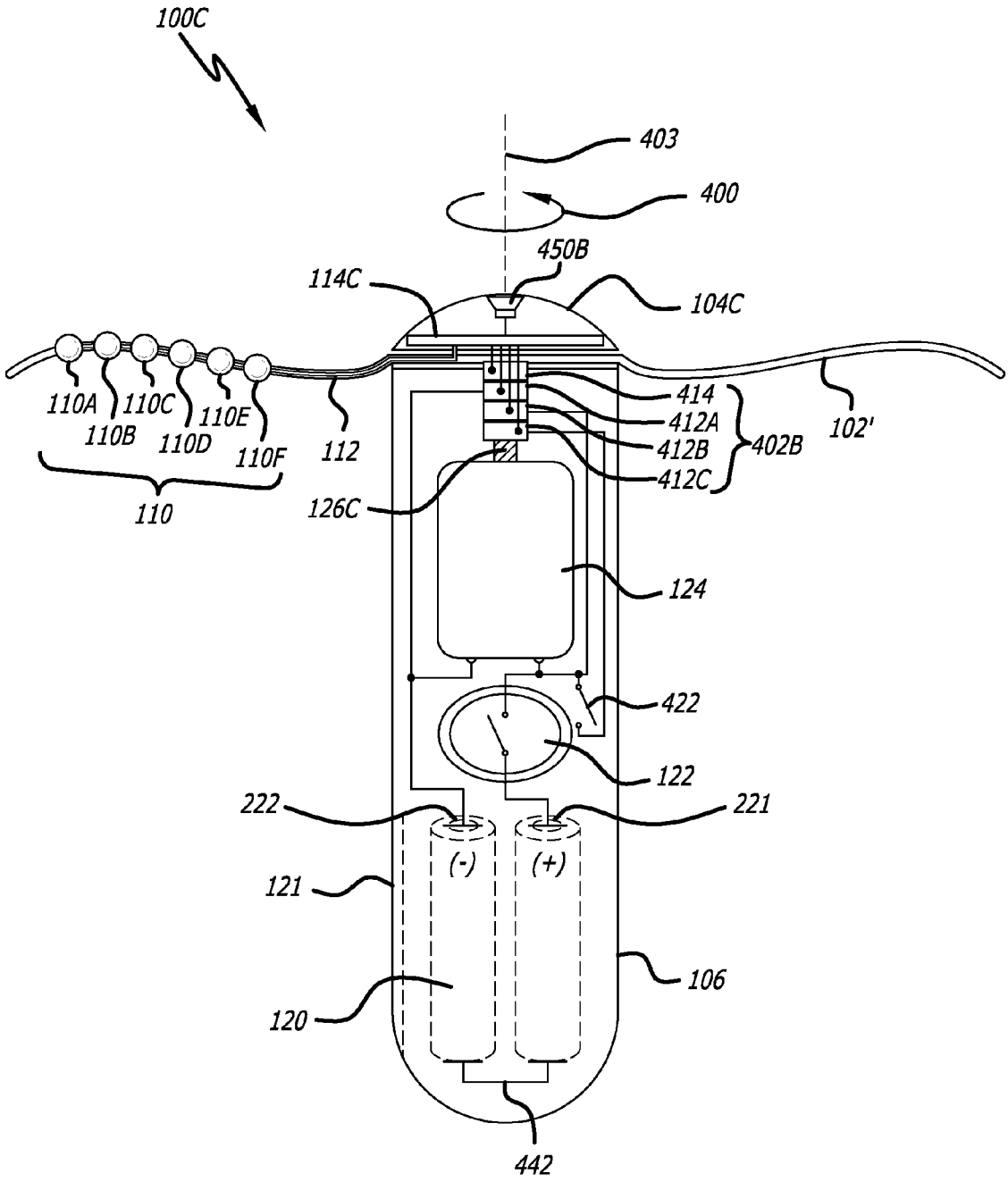
FIG. 4B is a cross-sectional view of another embodiment of the rotatable flexible disk toy with lighting.

Referring now to FIG. 4B, a cut-away view of a flexible rotatable disk toy 100C is illustrated. The rotatable flexible disk toy 100C includes lighting provided by the one or more light emitting diodes 110. The rotatable disk toy 100C differs from that of the rotatable disk toy 100B in that the printed circuit board 114C and the light controller (see light controller 801B in FIG. 8B) are mounted in the rotatable housing 104C. That is, all of the electronics are not mounted in the hand-held housing 106 of the rotatable flexible disk toy 100C. The flexible rotatable disk toy 100C is a preferred embodiment of the invention.

The rotatable flexible disk toy 100C includes a rotatable electrical connection 402B that is utilized to couple at least power and ground from the hand-held housing 106 into the rotatable housing 104B to power the printed circuit board 114C and the light controller to turn on and off the LEDs 110 in a controlled manner. In one embodiment of the invention, the rotatable electrical connection 402B includes a plurality of slip rings 412—one slip ring for ground 412A and one slip ring for power 412B around the shaft 126C of the electric motor 124. As the power the printed circuit board 114C and the light controller are mounted in the rotatable housing 104C, the number of slip rings in the connection 402B may be reduced from that of connection 402A. However, additional slip rings 412 may be provided in the rotatable electrical connection 402B to provide additional control. For example, a first pole of an optional mode switch 422 may couple to another slip ring 412C in the connection 402B to couple a mode control signal into the printed circuit board 114C and the light controller.

The rotatable electrical connection 402B may further include a rotary encoder 414 that may provide an indication of one rotation of the flexible disk 102 (referred to as a "once-around" encoder) or a finer resolution of angular rotation, such as every ten degrees of rotation over each three hundred sixty degrees or finer still generating a signal every single degree of rotation over each three hundred sixty degrees of rotation. The rotary encoder 414 may be used to provide angular position information and/or angular velocity information, such as the number of rotations per minute. The rotary encoder 414 may be simply formed by using an interruptible slip ring to generate a pulsating signal that is coupled into the printed circuit board 114C. The light controller can use the pulsating signal to determine the rotational velocity in rotations per minute of the rotatable housing 104C and the flexible disk 102'.

Additionally, the rotatable flexible disk toy 100C includes the switch 122, the battery door 121, a pair of power supply terminals 220-221, and the electric motor 124 mounted within the housing 106. The electric motor 124 includes the rotatable shaft 126B. An end of the rotatable shaft 126C couples to the flexible disk 102 and the rotatable housing 104C. The rotatable flexible disk toy 100C may further include an optional mode control switch 422 mounted within the housing 106.

A first pole of the switch 122 is coupled to the first power supply terminal 221. A second pole of the switch 122 is coupled to a first terminal of the motor 124 and to the slip ring 412A to couple power into the rotatable housing 104C. The second power supply terminal 220 is coupled to a second terminal of the motor 124 and to the slip ring 412B to couple ground into the rotatable housing 104C. One or more jumper wires 442 with terminals may be used to couple the one or more batteries in series together as illustrated or in parallel. With batteries properly coupled to the power supply terminals 220-221 and the switch 122 closed, a circuit is completed to provide power to the electric motor 124 to turn it on and rotate the rotatable shaft 126C and to provide power to the light controller to turn on and off the LEDs 110 in a controlled manner. Opening the switch 122 the circuit is opened and turns off the electric motor 124 so that the shaft is not rotated and the lighting of the LEDs 110 is turned off. In one embodiment of the invention, the switch 122 is a push button switch.

The optional mode control switch 422 has a first pole coupled to the second pole of the switch 122. The second pole of the optional mode control switch 422 is coupled the slip ring 412C. While switch 122 can turn on the motor 124 to spin the rotatable housing and provide power to the light controller so that a light pattern may be formed by the light emitting diodes 110, the optional mode control switch 422 can couple additional user input at the hand-held housing 106 into the PCB 114C and the light controller coupled thereto. The optional mode control switch 422 switches battery power through the slip ring 413 into the printed circuit board 114C and the light controller to change the mode of control to the light emitting diodes to have a different lighting effect. For example, closing the optional mode control switch 422 a first time after power up can signal the light controller to randomly generate a light pattern as the shaft 126C, the rotatable housing 104C, and the flexible disk 102' spin around together. Closing the optional mode control switch 422 a second time after power up can signal the light controller to generate a light pattern with letters and words, for example. Closing the optional mode control switch 422 a third time after power up can signal the light controller to generate a light pattern with graphics, for example. In this manner, the optional mode control switch 422 can be used to sequence through modes of operation of the rotatable flexible disk toy 100C. Additional control (e.g., motor control) and user input (entered by keypad for example) may be added to the rotatable flexible disk toy 100C as is discussed below with reference to the control electronics illustrated in FIG. 8C.

The rotatable flexible disk toy 100C further includes the rotatable housing 104C that is coupled to the flexible disk 102' and the rotatable shaft 126B. The shaft 126C, the rotatable housing 104C, and the flexible disk 102' rotate about an axis 403 as illustrated by the arrow 400.

The rotatable flexible disk toy 100C further includes the printed circuit board 114C with the light controller mounted in the rotatable housing 104C to control the lighting of the one or more light emitting diodes 110 through wires 112. The printed circuit board 114C and the light controller rotate with the rotatable housing 104C and the flexible disk 102' having the LEDs 110 and the wires 112. The rotatable housing 104C may be hollow or include a recess in which the printed circuit board and light controller may be mounted. The one or more LEDs 110 are coupled to the printed circuit board and the light controller by way of wires 112 in the flexible disk 102' and traces on the printed circuit board 114C. In one embodiment of the invention, the rotatable housing 104B is dome-shaped.

To provide further amusement to a user, the rotatable flexible disk toy 100C may further include a speaker 450B mounted in the rotatable housing 104C. As the rotatable housing 104B, the flexible disk 102', and the speaker 450B rotate, the speaker 450B may provide sound effects, music, or other sounds with or without the light pattern generated by the LEDs 110. The speaker 450B couples to the printed circuit board 114C to receive electrical sound signals. An amplifier in the light controller may drive the sound signals to the speaker where they are transduced into sound waves.

Figure 5A:
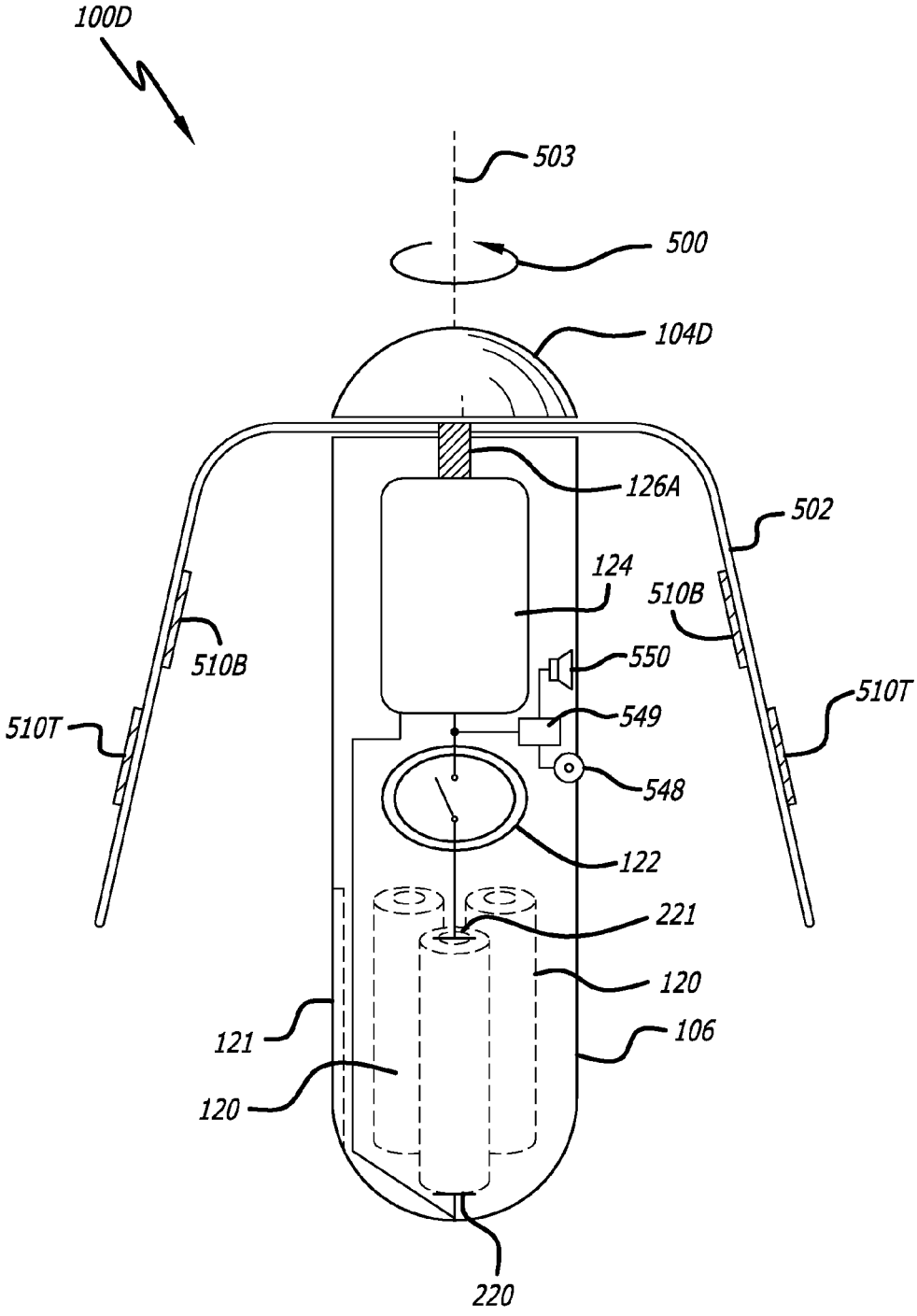
FIG. 5A is a cross-sectional view of another embodiment of the rotatable flexible disk toy but with indicia instead of lighting.

Referring now to FIG. 5A, a cut-away view of a rotatable flexible disk toy 100D is illustrated. The rotatable flexible disk toy 100D does not use one or more lights 110 (e.g., one or more light emitting diodes) to provide an amusing effect. Instead, the rotatable flexible disk toy 100D uses top indicia 510T on a top side of the flexible disk 502 and/or bottom indicia 510B on a bottom side of the flexible disk 502. In this case without lighting effects, the electronics of the flexible disk shape toy 100D can be simplified.

The rotatable flexible disk toy 100D includes the switch 122, the electric motor 124, and the pair of power supply terminals 220-221 mounted in the hand held housing 106. The power supply terminals 220-221 receive the one or batteries 120 through the battery door 121 individually or as part of a battery pack. The electric motor includes the shaft 126A having an end that couples to the rotatable housing 104D and the flexible disk 502.

As discussed previously, in one embodiment of the invention the switch 122 may be a push button switch that is pressed by a user to close the switch and couple power from the one or more batteries 120 into the electric motor 124 to cause the shaft 126A to spin. The switch 122 is coupled between a first power supply terminal 221 and a first terminal of the electric motor 124. The second power supply terminal 220 is coupled to a second terminal of the electric motor 124. The rotatable flexible disk toy 100D may include a motor controller to control the direction and velocity of the shaft, the rotatable housing and the flexible disk 502.

With the switch 122 open so that no power is supplied to the electric motor 124, the flexible disk 502 is in a limp condition folding down over the hand held housing 106 as illustrated by the cross-section of the flexible disk 502 in FIG. 5A. Closing the switch turns on the motor to spin the shaft 126A along with the rotatable housing 104D and the flexible disk 502 coupled thereto. As the flexible disk 502 is rotated it transitions from a limp condition by stretching out to become somewhat planar into a stretched or spinning condition.

To provide further amusement to a user, the rotatable flexible disk toy 100D may further include a volume control 548, a sound generator 549, and a speaker 550 mounted in the hand-held housing 16. In response to closing the switch 122, the sound generator 549 may generate sound effect signals with an amplitude controlled by the volume control 548. The sound effect signals are coupled into the speaker 550 where they are transduced into sound waves.

With no electronics in the rotatable housing 104D, it may be solid or hollow. In one embodiment of the invention, the rotatable housing 104D is dome shaped.

Figure 5B:
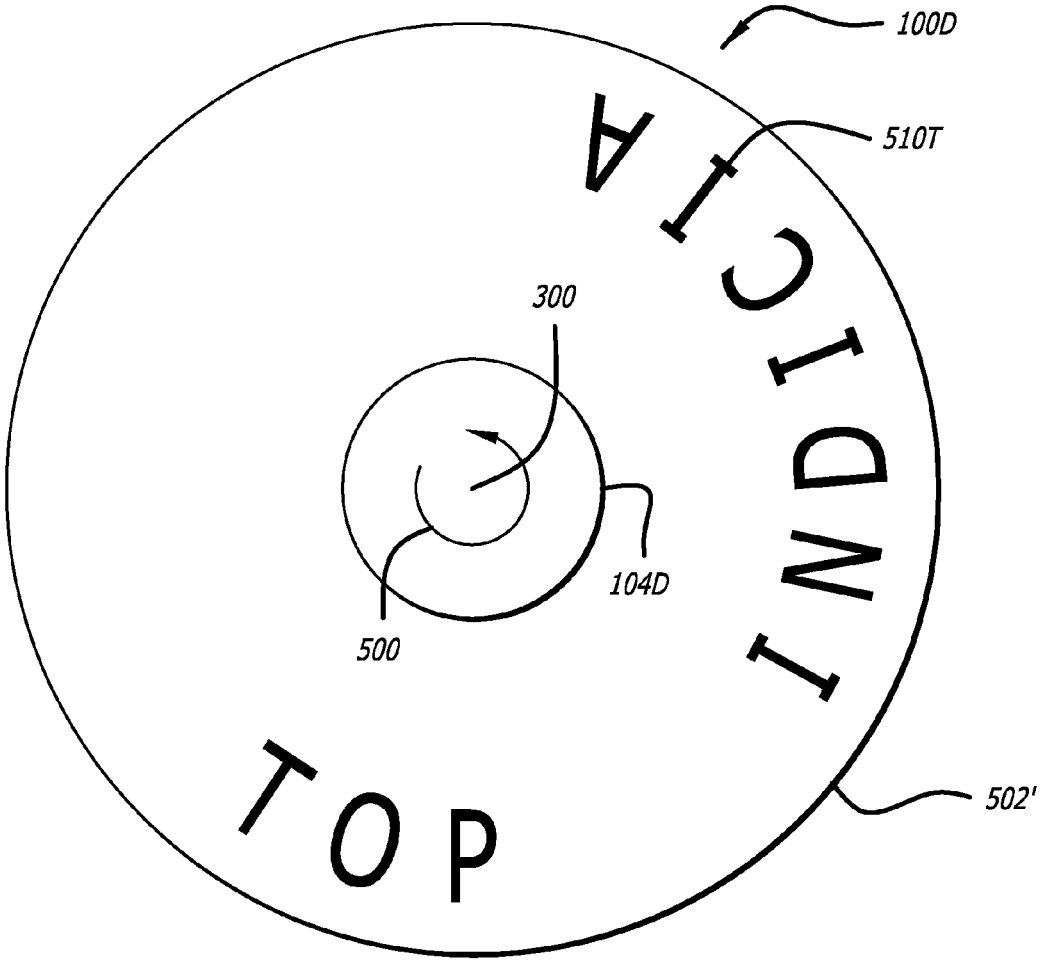
FIG. 5B is a top view of the rotatable flexible disk toy of FIG. 5A powered on with the rotatable flexible disk spinning.

Referring now to FIG. 5B, a top view of the rotatable flexible disk toy 100D is illustrated with the flexible disk 502 spinning in a stretched condition 502' so that it may be somewhat planar. The top indicia 510T coupled to a top side of the flexible disk 502 is better illustrated in FIG. 5B. The top indicia 510T and the bottom indicia 510B may be sewn to the flexible disk 502. Alternatively, the top and bottom indicia 510T, 510B may be printed onto the flexible disk 502. In either case, the flexible disk 502 rotates about the center point 300 along a rotational axis 503 as indicated by the arrow 500.

Figure 6:
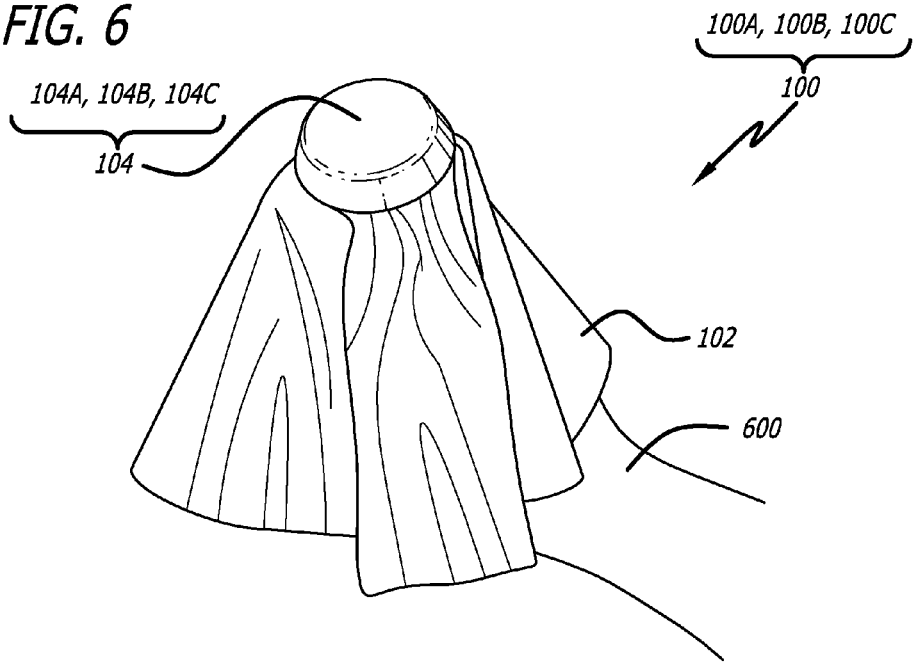
FIG. 6 is a perspective view of the embodiments of the rotatable flexible disk toy in a powered off state.

Referring now to FIG. 6, a perspective view of the rotatable flexible disk toy 100 powered off is illustrated. In FIG. 6 with the rotatable flexible disk toy 100 powered off, the flexible disk 102 is in a limp condition. In this case, a user has yet to close the switch 122 to turn on the toy 102 to spin the flexible disk 102 and flash the light emitting diodes 110 on and off. In the limp condition, the flexible disk 102 may fold and droop down from the rotatable housing 104 along the outside surface of the hand held housing 106. A users hand 600 holds the hand-held housing 106 but is mostly hidden from view by the limp condition of the flexible disk 102.

Figure 7A:
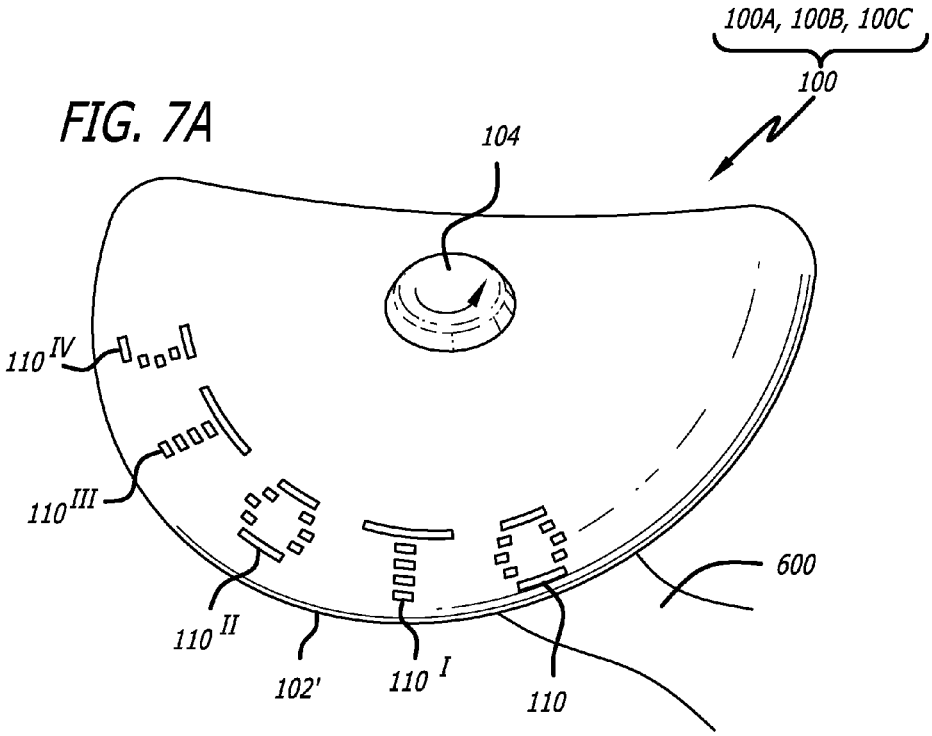
FIGS. 7A-7C are views of the embodiments of the rotatable flexible disk toys with lighting in a powered on state.
Figure 7B:
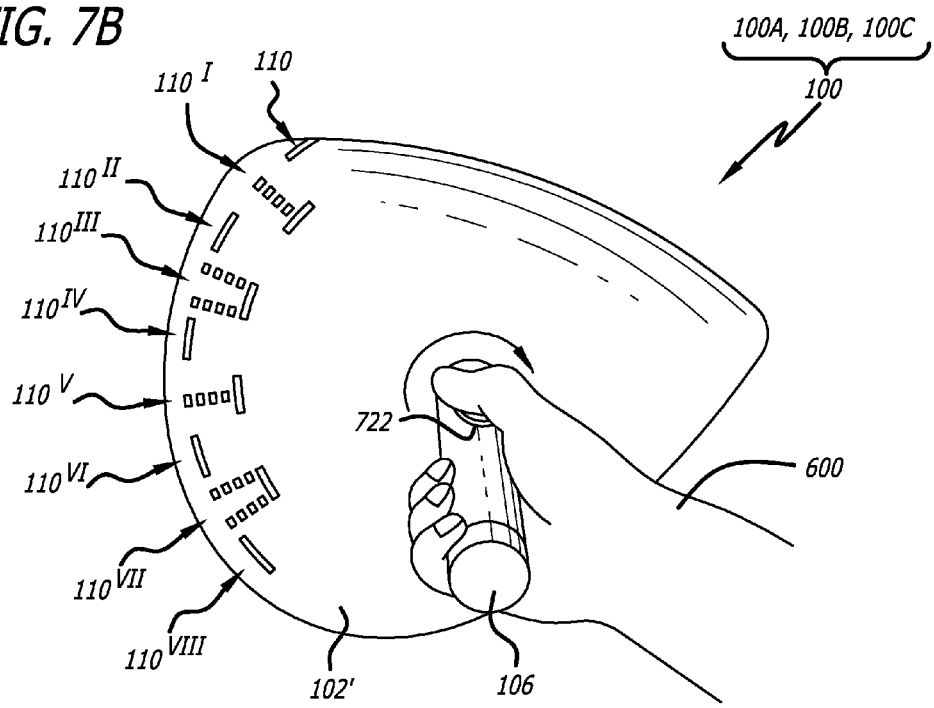
Figure 7C:
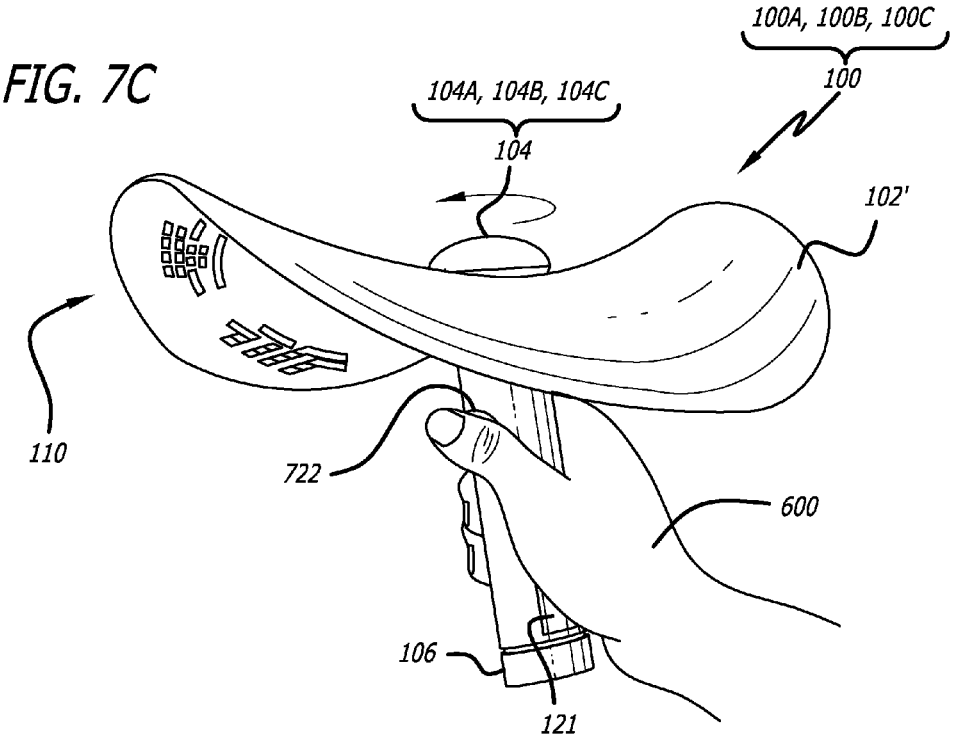

Referring now to FIGS. 7A-7C, various perspective views of the rotatable flexible disk toy 100 powered on are illustrated. In this case the user has closed the switch 122 to turn on the electric motor and the light controller so as to spin the flexible disk 102 and control the light emitting diodes 110. In FIGS. 7A-7C with the rotatable flexible disk toy 100 powered on, the flexible disk 102 is in a stretched condition. The one or more light emitting diodes 110 may be flashed on and off in order to display a lighting effect that may spell out words or letters or generate a graphical display. As illustrated by FIGS. 7B-7C, the one or more light emitting diodes 110 may be visible from both of the top and bottom sides of the flexible disk 102. FIGS. 7B-7C also better illustrate the users hand 600 holding the hand-held housing 106.

In FIG. 7A, a top perspective view of the rotatable flexible disk toy 100 is illustrated with the flexible disk 102' having rotated through an angle. As the flexible disk 102' has rotated through an angle, the one or more light emitting diodes 110 have flashed been flashed on and off at positions $\mathbf{110}^{I}$, $\mathbf{110}^{II}$, $\mathbf{110}^{III}$, and $\mathbf{110}^{IV}$. With the human persistence of vision, the eye sees the pattern of lights being generated on top of the flexible disk 102', such as the exemplary pattern illustrated in FIG. 7A.

In FIG. 7B, a bottom perspective view of the rotatable flexible disk toy 100 is illustrated with the flexible disk 102' having rotated through an angle. As the flexible disk 102' has rotated through an angle, the one or more light emitting diodes 110 have flashed been flashed on and off at positions $\mathbf{110}^{I}$, $\mathbf{110}^{II}$, $\mathbf{110}^{III}$, $\mathbf{110}^{IV}$, $\mathbf{110}^{V}$, $\mathbf{110}^{VI}$, $\mathbf{110}^{VII}$, and $\mathbf{110}^{VIII}$. With the human persistence of vision, the eye sees a pattern of lights being generated on the bottom of the flexible disk 102', such as the exemplary pattern illustrated in FIG. 7B. To power on the rotatable flexible disk toy 100, the user may press a push button 722 with a finger to close the switch 122.

In FIG. 7C, a side perspective view of the rotatable flexible disk toy 100 is illustrated with the flexible disk 102' having rotated through an angle. As the flexible disk 102' has rotated through an angle, the one or more light emitting diodes 110 have flashed been flashed on and off so that a user's eyes with the human persistence of vision see a pattern of lights being generated. FIG. 7C illustrates the flexibility in the flexible disk 102' even as it is spun. The hand-held housing 106 may be moved around to form different arc-like shapes in the flexible disk 102' as it is spun. By moving the rotatable flexible disk toy 100 around, the rotatable flexible disk 102 may take on various shapes and forms in its stretched condition but it is substantially not limp.

Figure 8A:
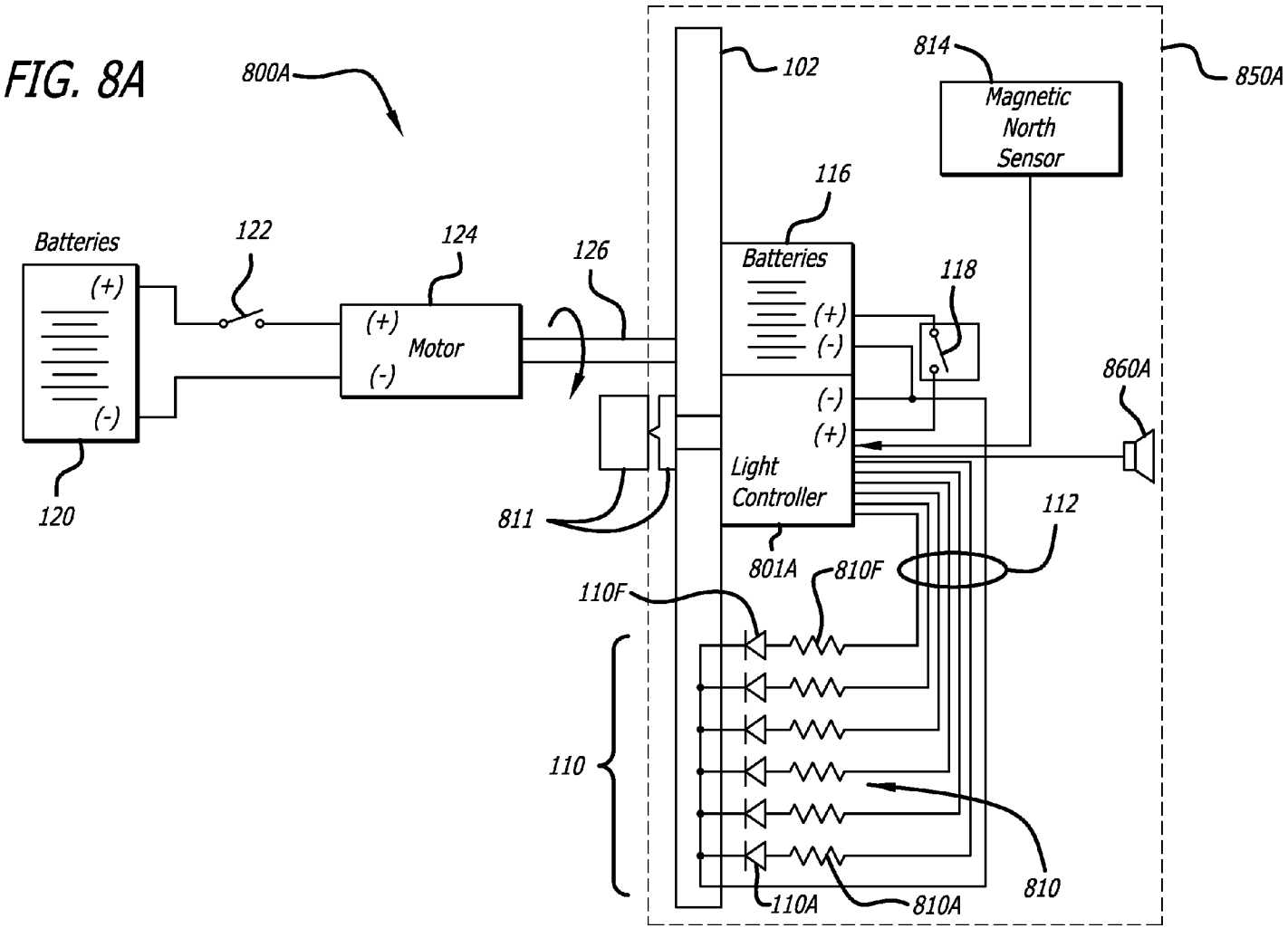
FIGS. 8A-8C are functional block diagrams of the control electronics in various embodiments of the rotatable flexible disk toy.
Figure 8B:
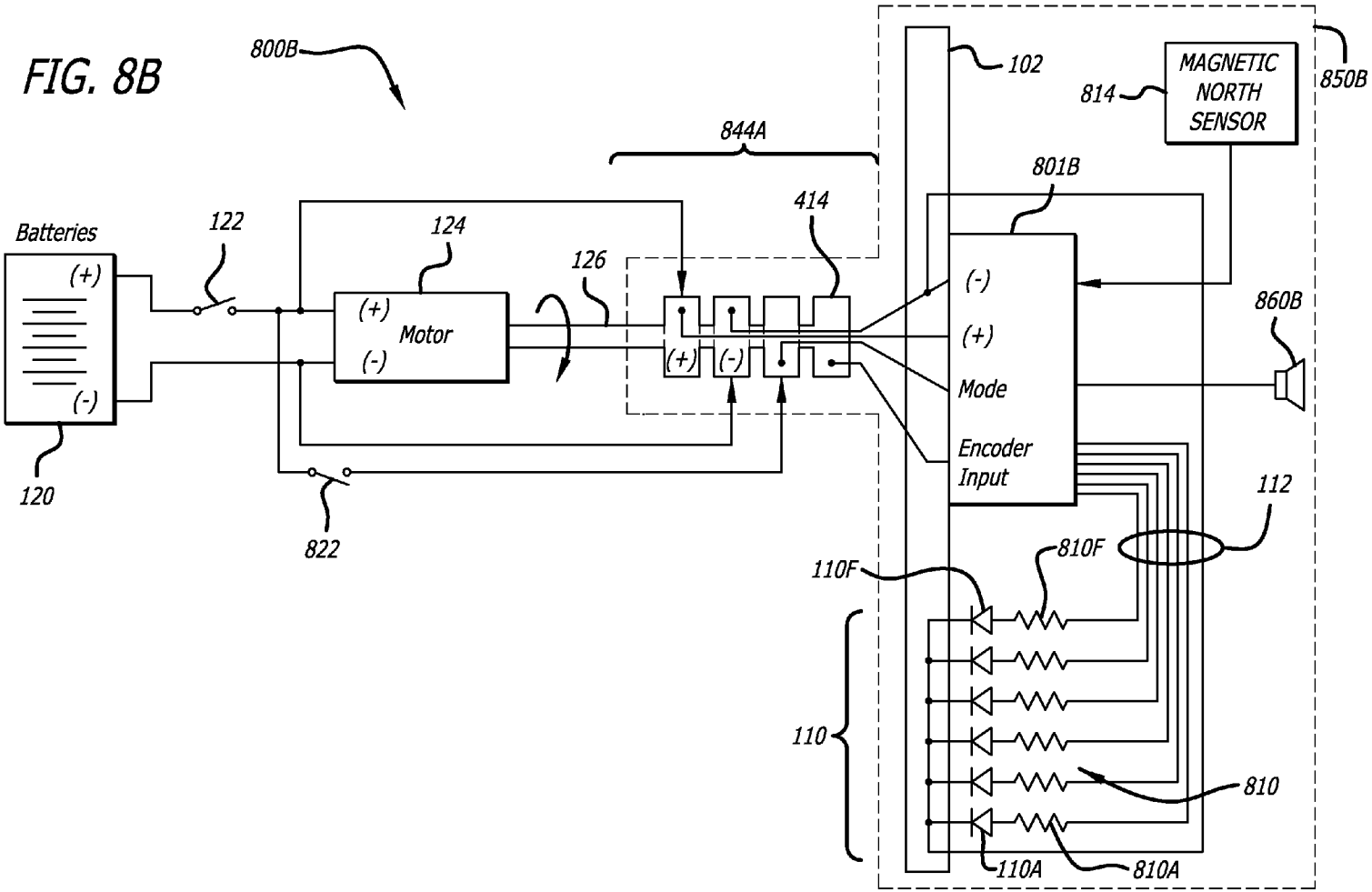
Figure 8C:
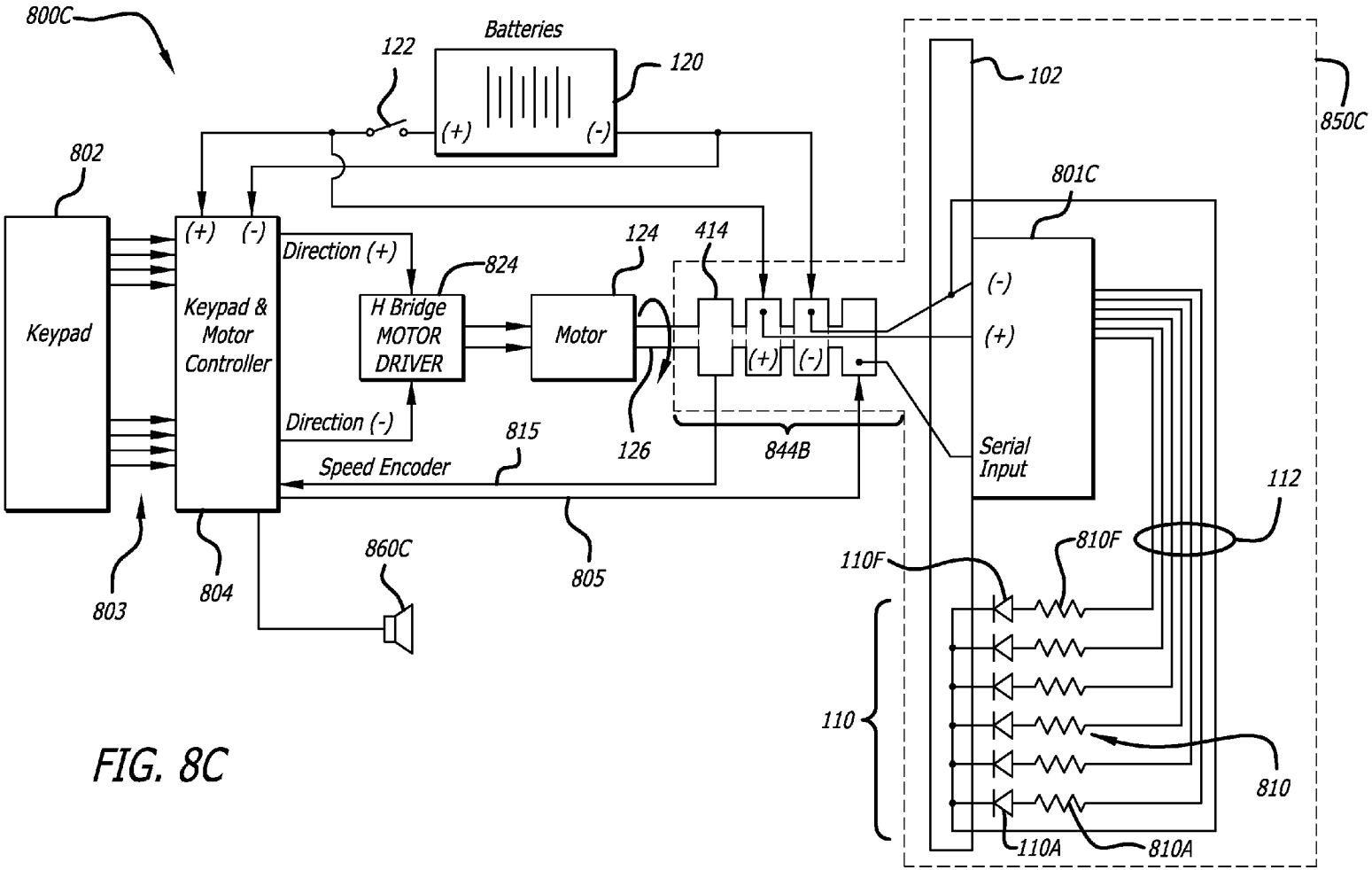

Referring now to FIGS. 8A-8C, functional block diagrams of the electronics 800A-800C for the rotatable flexible disk toy 100 are illustrated. The functional block diagrams of the electronics 800A-800C in the rotatable flexible disk toy 100 may each have a rotatable portion 850A-850C, respectively. The light controllers 801A-801C may be software programmable microcontrollers or microprocessors, such as a model SPC11A manufactured by Sunplus for example.

Referring now to FIG. 8A, a functional block diagram of the electronics 800A for the rotatable flexible disk toy 100 is illustrated. The electronics 800A includes a first power supply 120, a first switch 122, an electric motor 124, a second power supply 116, a light controller 801A, and one or more light emitting diodes 110 coupled together as shown. The electronics 800A may further include a second switch 118, such as a centrifugal switch 118, coupled between the power supply terminal from the second power supply 116 and the power terminal of the light controller 801A.

The electronics 800A may further include a rotary encoder 811, such as a once around encoder or a magnetic north sensor 814, to provide an indication of the angular rotation of the shaft 126, the flexible disk 102, and the one or more light emitting diodes 110. A once around encoder provides a once around indication, rotation of 360 degrees, to the light controller. The rotary encoder 811 may be used to wake up the light controller from a low power mode, in which case, the second switch 118 is not needed. With the information provided by the rotary encoder 811 or magnetic north sensor 814, the light controller 801A may somewhat synchronize the flashing of the one or light emitting diodes 110 to their angular rotation to form a light pattern using a human's persistence of vision.

The electronics 800A may further include a speaker 860A coupled to the light controller 801A to provide further amusement to a user. Electrical sound signals from the light controller 801A are coupled into the speaker 860A. The speaker 860A transduces the electrical sound signals into sound waves in air. The speaker 860A rotates with the rotatable portion 850A of the toy.

The first power supply 120 may be one or more batteries coupled together and mounted inside the housing 106 or a battery pack mounted inside the housing 106. The electric motor 124 receives power directly from the first power supply 120 through the first switch 122. The second power supply 116 may be one or more batteries coupled together and mounted within the rotatable dome shaped housing 104A or a battery pack mounted in the rotatable dome shaped housing 104A. The light controller 801A coupled to a printed circuit board receives power directly from the second power supply 116 or indirectly through the second switch 118.

The light controller 801A includes one or more outputs coupled to one or more wires of the wires 112 in the rotatable flexible disk 102 to drive a first terminal of the one or more light emitting diodes 110 high or low and flash them on and off respectively. One or more resistors 810 (resistors 810-810F) may respectively coupled between the one or more outputs of the light controller 801A and the first terminal of the one or more light emitting diodes 110. The resistors 810 prevent the outputs of the light controller from current overload that might occur if a light emitting diode were to short circuit to ground. A second terminal of the one or more light emitting diodes 110 is coupled to a common ground wire of the wires 112 in the rotatable flexible disk 102.

With the switch 122 closed by a user, the power supply 120 is coupled to the electric motor 124 to cause its shaft 126 to spin. The shaft 126 rotates the rotatable elements 850A of the electronics 800A. One element that may be rotated is the second switch 118, that may be a centrifugal switch that closes as it spins to couple the second power supply 116 to the light controller 801A. With the light controller 801A powered on, it may control the one or more light emitting diodes 110 so that an amusing light display is perceived on the flexible disk 102' as it spins. The light emitting diodes 110 may be randomly controlled by the light controller 801A in one embodiment of the invention to generate a pattern in lights on the spinning flexible disk 102.

Referring now to FIG. 8B, a functional block diagram of the electronics 800B for the rotatable flexible disk toy 100 is illustrated. The electronics 800B includes the power supply 120, the switch 122, the electric motor 124, a rotational electrical connection 844A, a light controller 801B, and one or more light emitting diodes 110 coupled together as shown. Optionally, the electronics 800B may further include a second switch 822 for mode control that is coupled between a pole of the first switch 122 and a mode input of the light controller 801B.

The rotational electrical connection 844A includes slip rings 412A-412B to provide power to the rotating elements 850B. The rotational electrical connection 844A may further include a rotational encoder 414 to provide angular or rotational information to the light controller 801B. As the shaft 126 rotates, a pulsing signal is generated by the rotational encoder 414 and coupled into the encoder input (ENIN) of the light controller 801B. The rotational encoder 414 may provide a measure of the velocity or rotations per minute of the shaft 124A and/or angular position information. Alternatively, a magnetic north sensor 814 may be provided with a signal coupled into the light controller 801B to provide an indication of the angular rotation of the shaft 126, the flexible disk 102, and the one or more light emitting diodes 110. With the information provided by the rotary encoder 414 or the magnetic north sensor 814, the light controller 801B may somewhat synchronize the flashing of the one or light emitting diodes 110 to their angular rotation to form a light pattern using a human's persistence of vision.

If the second switch 822 for mode control is included as part of the rotatable flexible disk toy 100, the rotational electrical connection 844A further includes a slip ring 412C to couple the mode control signals into the light controller 801B. The mode control signals may provide some user control to the light controller 801B, such as to select a light pattern, light speed, light color, sound volume, etc.

Similar to the electronics 800A, the electronics 800B may further include a speaker 860B coupled to the light controller 801B to provide further amusement to a user. Electrical sound signals from the light controller 801B are coupled into the speaker 860B. The speaker 860B transduces the electrical sound signals into sound waves in air. The speaker 860A rotates with the rotatable portion 850B of the toy.

The power supply 120 may be one or more batteries coupled together and mounted inside the housing 106 or a battery pack mounted inside the housing 106. The electric motor 124 receives power from the power supply 120 through the switch 122. With the switch 122 closed, the power supply 120 is coupled to the electric motor 124 such that its shaft 126 rotates. Additionally with the switch 122 closed, the power supply 120 is also coupled to the light controller 801B through the slip rings 412A-412B to control the flashing of the one or more light emitting diodes 110 on and off.

The light controller 801B includes output drivers to similarly couple to the light emitting diodes 110 through the wires 112 and resistors 810 similar to how the light controller 801A is coupled as described above.

Referring now to FIG. 8C, a function block diagram of electronics 800C are illustrated for the rotatable flexible disk toy 100. The electronics 800C includes the power supply 120, the switch 122, a key pad user interface 802, a keypad scanner/motor control processor 804, a motor driver circuit 824, the electric motor 124, a rotational electrical connection 844B, a light controller 801C, one or more resistors 810, and one or more light emitting diodes 110 coupled together as shown. The light controller, the one or more resistors 810, a portion of the rotational electrical connection 844B, and the one or more light emitting diodes 110 are some of the rotating elements 850C of the electronics 800C.

The rotational electrical connection 844B includes the slip rings 412A-412B to provide power to the rotating elements 850C. The rotational electrical connection 844B includes an additional slip ring 412C to allow serial control signals 805 from the keypad scanner/motor control processor 804 to be coupled to a serial input of the light controller 801C. The rotational electrical connection 844B further includes the rotational encoder 414 to provide angular or rotational information to the processor 804. As the shaft 126 rotates, a pulsing speed encoded signal 815 is generated by the rotational encoder 414 to provide an indication of the angular velocity or rotational speed of the shaft 126 of the motor. The speed encoded signal 815 is coupled into an encoder input of the processor 804. The rotational encoder 414 may provide a measure of the velocity or rotations per minute of the shaft 124 and/or angular position information. With the information provided by the rotary encoder 414, the processor 804 can properly control the speed of the motor 124 through the motor driver circuit 824.

The serial control signals from the keypad scanner/motor control processor 804 to the light controller 801C may provide some user control, such as to select a light pattern, light speed, light color, sound volume, etc. Additionally, the keypad scanner/motor control processor 804 may also signal the light controller 801C over the serial communication link 805 to synchronize the flashing of the one or light emitting diodes 110 to their angular rotation to form a desired light pattern using a human's persistence of vision.

The desired light pattern generated by flashing of the one or light emitting diodes 110 may be keyed in by a user through the keypad 802. The keypad 802 generates key signals 803 responsive to the keys being selected. The key signals 803 are coupled into the key scanner/motor control processor 804 to receive user input information. That is, the rotatable flexible disk toy is programmable by the key pad user interface 802. Additional user input may be entered through the keypad 802. The key scanner/motor control processor 804 couples to the power supply 120 through the switch 122. The key pad user interface 802 may be powered by the power supply or by signals from the processor 804.

The electronics 800C may further include a speaker 860C coupled to the processor 804 to provide further amusement to a user. Electrical sound signals from the processor 104 are coupled into the speaker 860C. The speaker 860C transduces the electrical sound signals into sound waves in air. In this case, the speaker 860C is not part of the rotatable portion 850C of the toy and thus does not rotate.

The motor driver circuit 824 is an H-bridge circuit to drive a direct current (DC) motor in one embodiment of the invention. The processor 804 generates a first direction control signal to control the motor 124 in a first rotational direction. The processor 804 generates a second direction control signal to control the motor 124 in a second rotational direction. In this manner, the electric motor may additionally be controlled, such as to change direction and/or change angular velocity in response to the type of images to be displayed by the spinning of the one or more LEDs 110.

The light controller 801C couples to the power supply through the slip rings when the switch 122 is closed. The power supply 120 may be one or more batteries coupled together and mounted inside the housing 106 or a battery pack mounted inside the housing 106. The light controller 801C controls the flashing of the one or more light emitting diodes 110 on and off in response to user information supplied as serial signals over the serial communication link 805. The light controller 801C includes output drivers to similarly couple to the light emitting diodes 110 through the wires 112 and resistors 810 similar to how the light controller 801A is coupled as described above.

Figure 9:
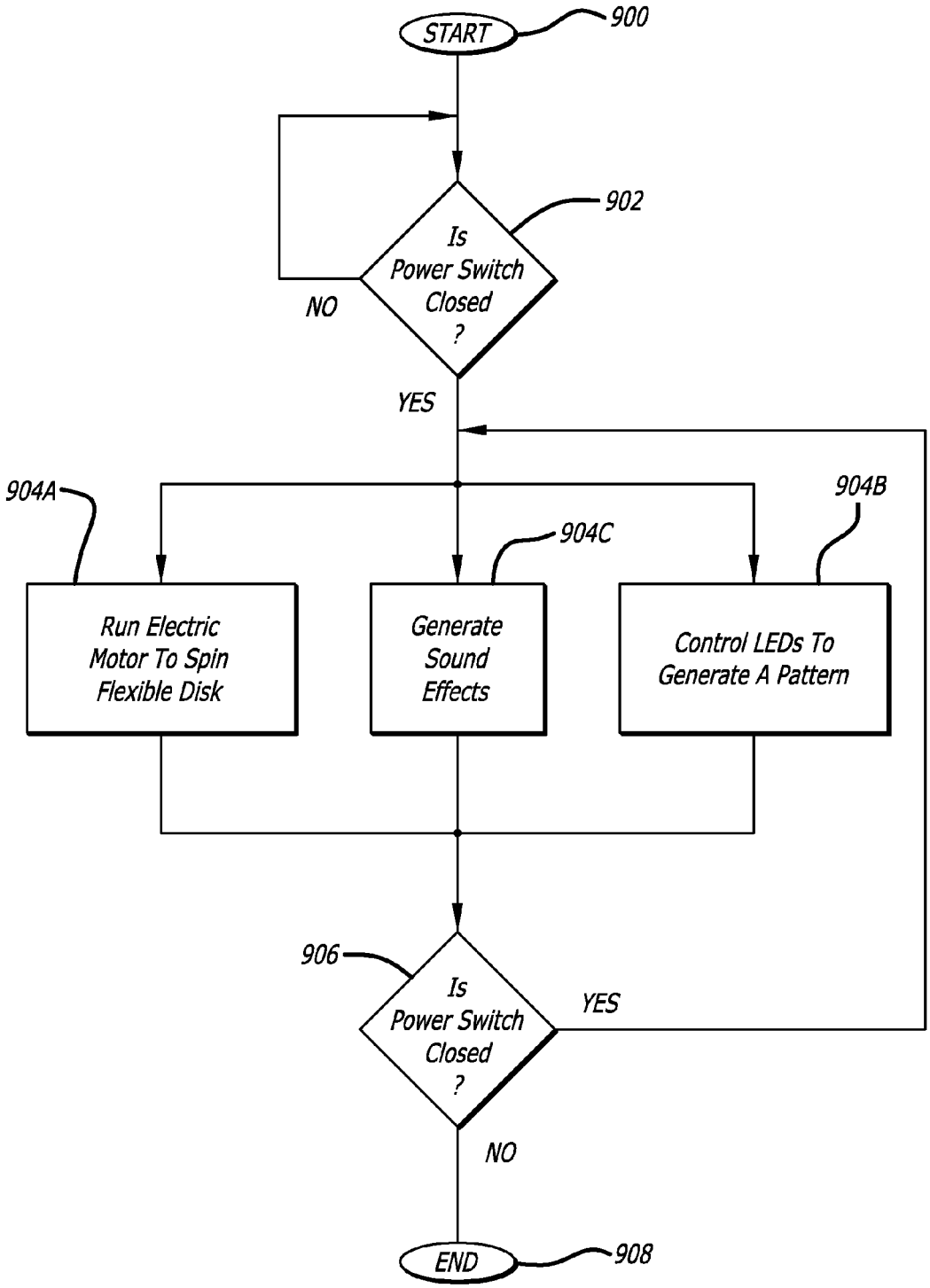
FIG. 9 is a flow chart of a method of random generation of lighting in an embodiment of the rotatable flexible disk toy to form a pattern.

Referring now to FIG. 9, a flow chart of a method of random generation of lighting in a rotatable flexible disk toy is illustrated. The method starts at block 900 and goes to block 902.

At block 902, a determination is made as to whether or not the power switch 122 is closed. If not, the method loops around waiting for the power switch to be closed to turn on the rotatable flexible disk toy. If so, the method goes to blocks 904A and 904B.

At block 904A, the electric motor 124 is run to spin the flexible disk 102.

At block 904B, coincidental to running the electric motor 124, the light emitting diodes 110 may be controlled to generate a pattern in lights with the spinning of the flexible disk 102. In one embodiment of the invention, the light emitting diodes 110 are randomly controlled to generate a random light pattern with the spinning of the flexible disk 102. In another embodiment of the invention, the light emitting diodes 110 are sequentially controlled, such as is discussed with reference to FIG. 10, for example.

At block 904C in another embodiment of the invention, coincidental to running the electric motor 124, sound effects may be generated such as by a sound generator for example. The sound effects may be generated with or without control of the light emitting diodes 110 to generate a light pattern as discussed with reference to block 904B. That is, the sound effects may be generated in addition to the light patter generated by the LEDs 110 or in lieu thereof.

The method then goes to block 906. At block 906, a determination is made as to whether or not the power switch 122 remains closed. If the switch is still closed, the method goes back to continue to perform blocks 904A and 904B. If not, the method ends at block 908 and the electric motor and electric lights are powered off. The method then goes back to start again at block 900 and waits for the power switch to be closed at block 902.

Figure 10:
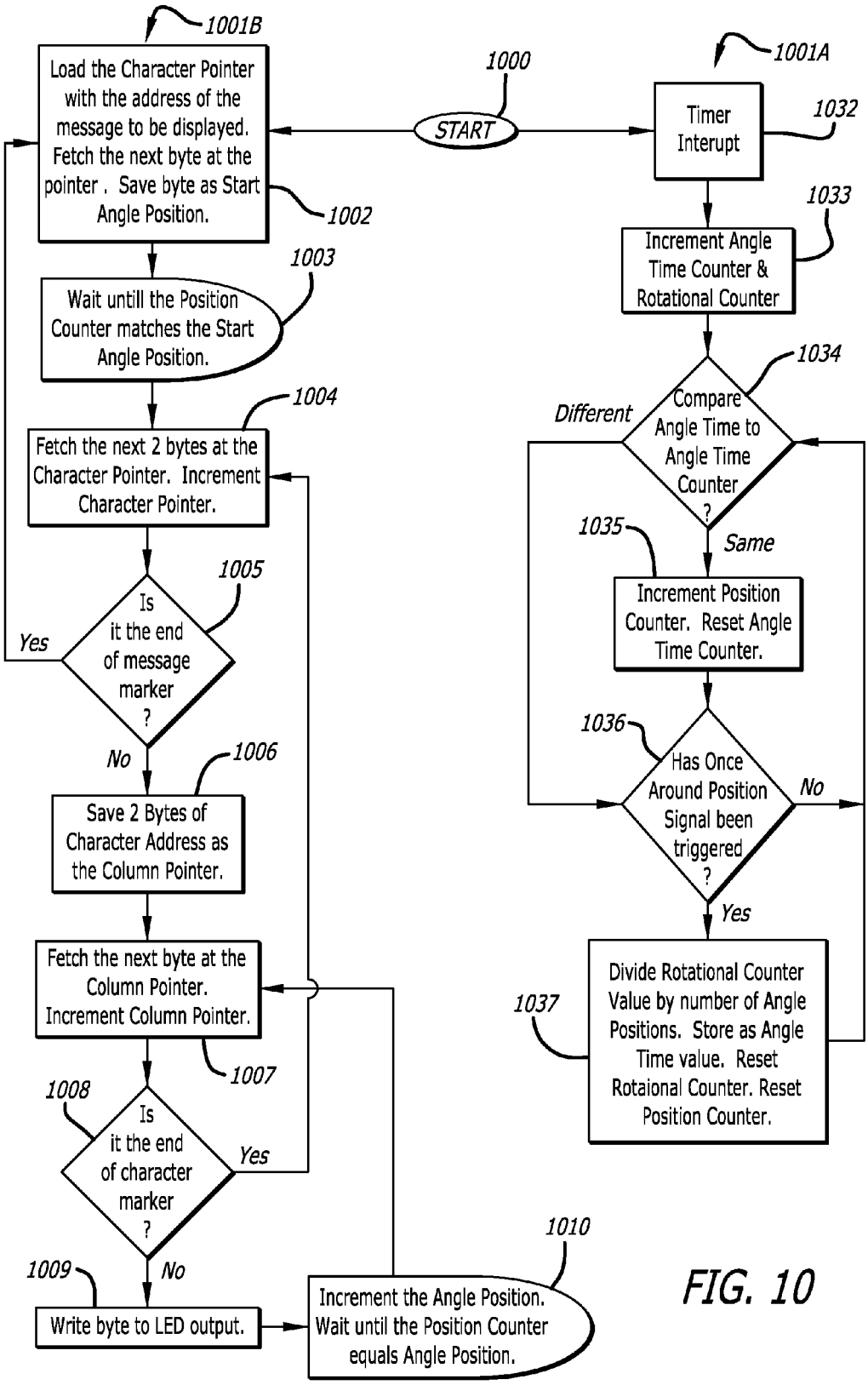
FIG. 10 is a flow chart of a method of lighting control to display characters or graphics in lights in an embodiment of the rotatable flexible disk toy.

FIG. 10 is a flow chart of a method of sequential lighting control to display characters or graphics in lights in an embodiment of the rotatable flexible disk toy. A once around rotary encoder may be used to provide a positional signal every 360 degrees of rotation of the flexible disk 102. In which case, a first process 1001A (blocks 1032-1037) keeps track of the position of the LEDs over the 360 degrees of rotation of the flexible disk through a position counter 1105. In the first 360 degrees of rotation in the flexible disk 102, the values used in the process may not be properly initialized. During the second and subsequent rotations of the flexible disk 102, the values are proper for tracking the position of the LEDs. At block 1037, the process may re-compute values each revolution of the flexible disk 102 to compensate for motor speed variations. A second process 1001B (blocks 1002-1010) illustrated in FIG. 10, writes the bytes of a message to the LED output driver/register 1130 synchronized to the position counter 1105 to drive the LEDs as they spin around with the flexible disk 102.

Figure 11:
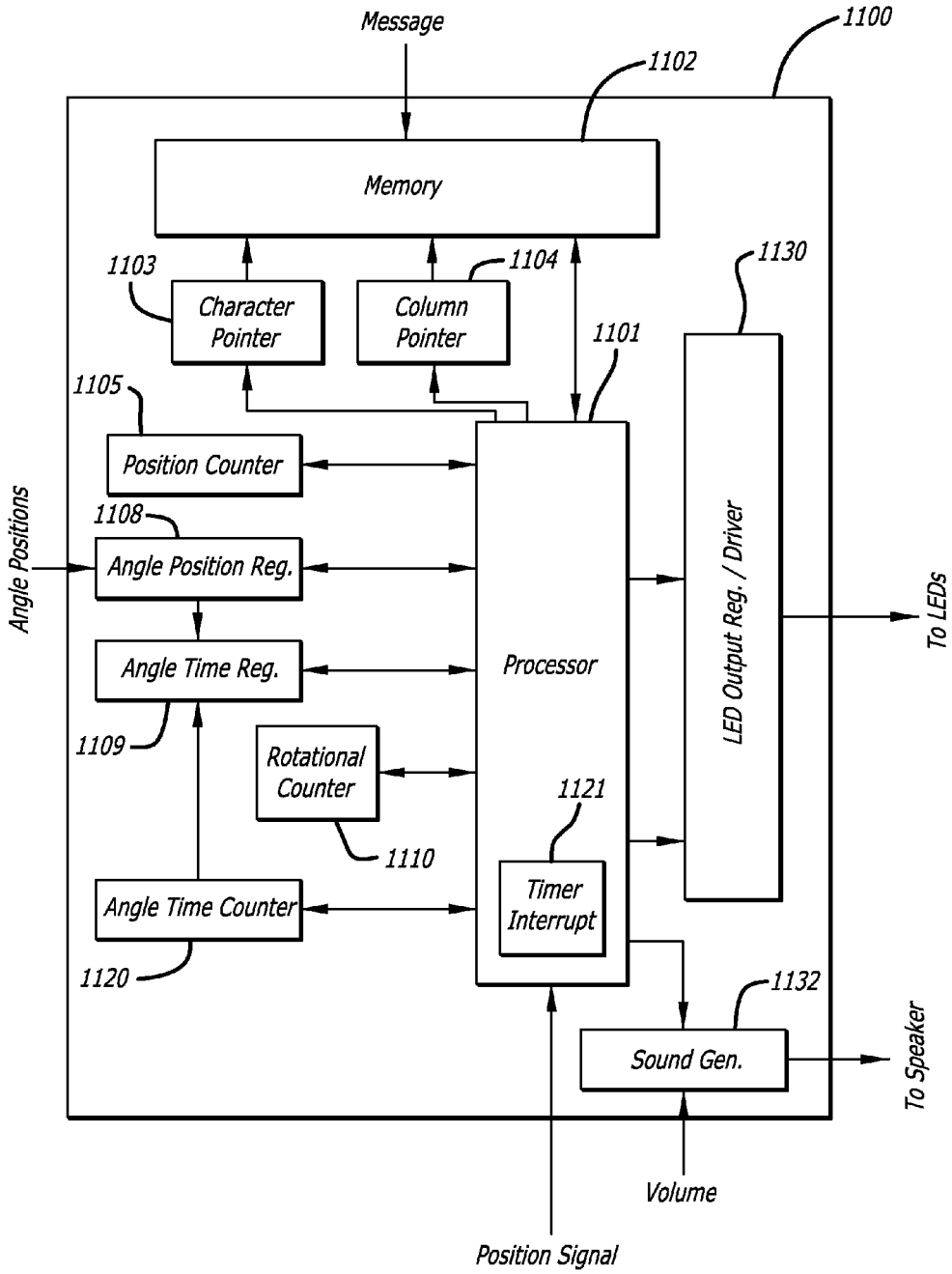
FIG. 11 is a block diagram of an exemplary light controller.

FIG. 11 is a block diagram of an exemplary light controller 1100. The light controller includes a processor 1101, a memory 1102, a character pointer 1103, a column pointer 1104, a position counter 1105, an angle position register 1108, an angle time register 1109, a rotational counter 1110, an angle time counter 1120, an LED output register/driver 1130, and a sound generator 1132 coupled together as shown.

The processor includes a timer interrupt function 1121 that is programmable to issue an interrupt periodically to the processor 1101.

The sound generator 1132 may generate sound effect signals in response to a signal from the processor 1101. The amplitude of the sound effect signals may be controlled by a volume control signal, "Volume". The sound effect signals are coupled into a speaker where they are transduced into sound waves. The sound effect signals may be synchronized with the light pattern generated by the one or more LEDs 110.

The LED output register/driver 1130 drives the one or more LEDs 110 to generate the light pattern.

The memory 1102 may be random access memory, read only memory, or a combination thereof. The memory 1102 can store a message, characters encoded into a light pattern, and other functions/data associated with the operation of the spinning toy.

Figure 12:
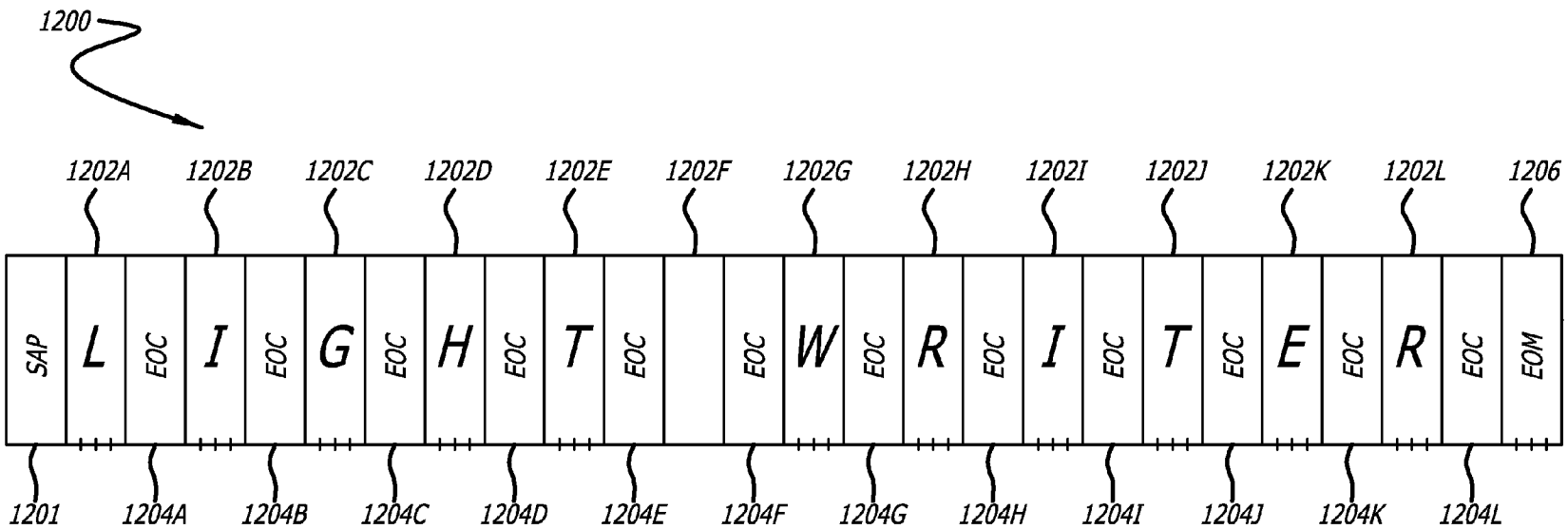
FIG. 12 is an illustration of an exemplary message that may be stored in the memory of the exemplary light controller of FIG. 11.

FIG. 12 illustrates an exemplary message 1200 that may be displayed as a light patter. The exemplary message may be stored in the memory 1102, in ROM, RAM or a combination thereof. A set of characters may be encoded into a light pattern and stored in the memory. The message 1200 includes a start angle position (SAP) 1201, one or more characters or character addresses 1202A-1202L, one or more end of character marks (EOC) 1204A-1204L, and an end of message mark (EOM) 1206. In the case that character addresses 1202A-1202L are provided in the message, the encoded light patter associated with the selected character is stored in memory at the character address.

Referring now to FIGS. 10-11, the method of sequential lighting control starts at the start block 1000 and then the first and second processes 1001A-100B are concurrently performed with the exemplary light controller 1100.

The first process 1001A begins at block 1032 and is now explained in detail.

At block 1032, a general purpose time interval interrupt, common in microcontrollers, is processed using the timer interrupt function 1121 of the processor 1101. As discussed previously, the timer interrupt function 1121 is programmable and periodically issues a timer interrupt. The timer interrupt 1032 may be based on the clock and clock frequency of the processor 1101.

Next at block 1033, the angle time counter 1120 and the rotational counter 1110 are incremented by the processor for each timer interrupt.

Next at block 1034, the angle time stored in the angle time register 1109 is compared to the value of the angle time counter 1120. The angle time stored in the angle time register 1109 represents the expected time that the disk is to spin through a given angle over a lighting position, and is less than three-hundred sixty degrees. For example, there may be one-hundred-eighty lighting positions around the rotation of the disk such that the angle time may represent the time that it takes to spin the disk two degrees, for example. Of course one will note that different number of lighting positions will provide different angles of rotation and different angle times and is herein contemplated.

If the value in the angle time counter 1120 differs from the angle time, then the process goes to block 1036, skipping block 1035. If the value in the angle time counter 1120 is the same as the angle time, then the process goes to block 1035.

At block 1035, the position counter 1105 is incremented and the angle time counter 1120 is reset to its initial value. In this case, the disk has moved to the next position of the LED lighting sequence around the three-hundred-sixty-degree circle. The process then goes to block 1036.

At block 1036, a determination is then made by the processor 1101 as to whether or not the once around position signal has been triggered. The once around position signal is triggered each time the disk rotates through a three-hundred-sixty-degree circle. The position signal may be triggered by a once around encoding generated by the rotary encoder 811, the rotational encoder 414, the magnetic north sensor 814, or the control processor 804, for example.

If the once around position signal has been triggered, then the process goes to block 1037. If the once around position signal has not been triggered, then the process loops back to block 1034, skipping the process performed at block 1037.

At block 1037, assuming the once around position signal has been triggered, the value of the angle time is re-computed by the processor 1101 to compensate for motor speed variations and stored in the angle time register 1109. This is useful as the batteries may wear down and progressively turn the disk more slowly, or when the batteries are strong, the disk may spin faster than was initially expected. In either case, it is desirable to synchronize the sequential lighting of the LEDs as the disk rotates. Additionally with the once around position signal having been triggered, the rotational counter 1110 and the position counter 1105 are reset to their respective initial values. The process then loops back to block 1034 and continues.

Referring now to FIGS. 10-12, the second process 1001B starts at block 1002 and is now explained in detail.

At block 1002, the character pointer 1103 is loaded with the starting address of the message that is to be displayed. At the value of the character pointer 1103, fetch the next byte of data. Save the byte as the start angle position 1201. The process then goes to block 1003.

At block 1003, the process waits until the position counter 1105 matches the start angle position 1201.

Next at block 1004, the next two bytes of data are fetched at the character pointer 1103 and increment the character pointer 1103. The process then goes to block 1005.

At block 1005, the two bytes of data just fetched are analyzed to determine whether there is an end of message (EOM) marker 1206 or not. If there is no end of message (EOM marker), the process goes to block 1006. If there is an end of message (EOM marker), the process loops back to block 1002 as the message was either completely displayed or there was no message to display.

At block 1006, assuming that the two bytes of data just fetched do not indicate an end of message marker 1206, the two bytes just fetched are character address and are saved as the column pointer 1104.

Next at block 1007, the next byte of data is fetched at the column pointer 1104. The column pointer 1104 is incremented and the process goes to block 1008.

At block 1008, a determination is made if the byte of data just fetched is an end of character (EOC) 1204A-1204L or not.

If is not an end of character (EOC) marker, the process goes to block 1009. If it is an end of character (EOC) marker, the process loops back to block 1004 to fetch the next two bytes of data that may be the next character, or an end of message marker.

At block 1009, the byte of data just fetched is written to the LED output register/driver 1130 and the process then goes to block 1010.

At block 1010, the angle position stored in the angle position register 1108 is incremented by the processor 1101. The process then waits until the position counter 1105 is equal to the angle position stored in the angle position register 1108 to drive the LEDs with the value stored in the LED output register/driver 1130. With the position counter 1105 equal to the angle position stored in the angle position register 1108, the process loops back to block 1007 to fetch the next byte of data. The next byte of data may be the next character or an end of character marker.

While certain exemplary embodiments have been described and shown in the accompanying drawings, it is to be understood that such embodiments are merely illustrative of and not restrictive on the broad invention, and that the embodiments of the invention not be limited to the specific constructions and arrangements shown and described, since various other modifications may occur to those ordinarily skilled in the art. For example, while FIGS. 10 and 12 illustrate the generation of text messages, graphic images may be similarly generated with the appropriate calls to memory locations storing graphics information. Instead, the embodiments of the invention should be construed according to the claims that follow below

What is claimed is:

1. A spinning toy comprising:

a hand-held housing;

an electric motor mounted in the hand-held housing, the electric motor having a rotatable shaft, a switch mounted in the hand-held housing electrically coupled to the electric motor, the switch to selectively provide power to the electric motor;

a flexible disk coupled to be rotated by the rotatable shaft of the electric motor;

wherein the flexible disk is in a limp condition so that the flexible disk is pulled down and droops toward ground by gravity when not rotated by the rotatable shaft of the electric motor, and transitions to a stretched condition in response to rotation of the rotatable shaft.

2. The spinning toy of claim 1, wherein the flexible disk further having indicia coupled to a top surface thereof.

3. The spinning toy of claim 2, wherein the indicia are graphic symbols.

4. The spinning toy of claim 1 further comprising:

a speaker to provide sound effects in response to closure of the switch.

5. The spinning toy of claim 1, further comprising:

a rotatable housing mounted over the flexible disk having a center coupled to the rotatable shaft of the electric motor, the rotatable housing to spin with the flexible disk.

6. The spinning toy of claim 5, wherein the flexible disk is a flexible disk-like shaped fabric.

7. The spinning toy of claim 5, wherein the flexible disk is a flexible disk-like shaped plastic.

8. The spinning toy of claim 1 further comprising:

a plurality of light emitting diodes (LEDs) mounted to the flexible disk;

the switch also being coupled to provide power to periodically activate the plurality of light emitting diodes.

9. A method for a child's plaything, the method comprising:

closing a first electrical switch to couple power to an electric motor;

spinning a flexible disk coupled to a shaft of the electric motor;

periodically activating a plurality of light emitting diodes (LEDs) mounted to the flexible disk: and closing a second electrical switch in response to the spinning of the flexible disk to coupled power to a light controller to periodically activate the plurality of light emitting diodes (LEDs).

10. The method of claim 9, wherein the first electrical switch is a push-button switch that is closed by a user pressing on a button, and the second electrical switch is a centrifugal switch that is closed by a centrifugal force generated by spinning the flexible disk.

11. A method for a child's plaything, the method comprising:

closing a first electrical switch to couple power to an electric motor;

spinning a flexible disk coupled to a shaft of the electric motor;

periodically activating a plurality of light emitting diodes (LEDs) mounted to the flexible disk; and the flexible disk is centrifugally stretched from a limp condition into a stretched condition in response to the spinning.

12. The method of claim 11, further comprising generating sound effects in response to the spinning of the flexible disk.

13. The method of claim 11, wherein the plurality of LEDs are randomly activated to generate a random light pattern.

14. The method of claim 11, wherein the plurality of LEDs are sequentially activated as the flexible disk is rotated to generate one or more text messages that are viewed by a human persistence of vision.

15. The method of claim 11, wherein the plurality of LEDs are sequentially activated as the flexible disk is rotated to generate graphics that are viewed by a human persistence of vision.

16. A rotatable light toy comprising:

a first housing having a first pair of power supply terminals to receive one or more first batteries;

an electric motor mounted in the first housing, the electric motor having a rotatable shaft;

a first switch mounted in the first housing having a first pole coupled to one of the first pair of power supply terminals, the switch to close to provide power to the rotatable light toy;

a flexible disk having a center portion coupled to the rotatable shaft of the electric motor, the flexible disk to become stretched out in response to rotation;

a plurality of lights mounted to the flexible disk;

a second housing coupled to the rotatable shaft and the flexible disk, the second housing to rotate with the flexible disk;

a light controller mounted in the second housing and coupled to the plurality of lights, the light controller to periodically flash the plurality of lights on and off to generate a light pattern when the flexible disk is rotated; and a rotational electrical connection having a pair of slip rings to couple power and ground to the light controller.

17. The rotatable light toy of claim 16, further comprising a second switch mounted in the first housing, the second switch to generate a mode signal for the light controller to change a mode of operation;

and wherein the rotational electrical connection further has a third slip ring to couple the mode signal from the second switch in the first housing to the light controller in the second housing.

18. The rotatable light toy of claim 17, wherein the rotational electrical connection further has a rotational encoder to generate a signal to couple to the light controller to synchronize the periodic flashing of the plurality of lights with the rotation of the flexible disk.

19. A rotatable light toy comprising:

a first housing having a first pair of power supply terminals to receive one or more first batteries;

an electric motor mounted in the first housing, the electric motor having a rotatable shaft;

a first switch mounted in the first housing having a first pole coupled to one of the first pair of power supply terminals, the switch to close to provide power to the rotatable light toy;

a flexible disk having a center portion coupled to the rotatable shaft of the electric motor, the flexible disk to become stretched out in response to rotation;

a plurality of lights mounted to the flexible disk;

a second housing coupled to the rotatable shaft and the flexible disk and having a second pair of power supply terminals to receive one or more second batteries, and, the second housing to rotate with the flexible disk;

a light controller mounted in the second housing and coupled to the plurality of lights, the light controller to rotate with the second housing and the flexible disk and periodically flash the plurality of lights on and off to generate a light pattern when the flexible disk is rotated.

20. The rotatable light toy of claim 19, further comprising a second switch mounted in the second housing, the second switch to couple power to the light controller.

21. The rotatable light toy of claim 20, wherein the second switch is a centrifugal switch to close and couple power to the light controller in response to a rotation of the second housing.

22. The rotatable light toy of claim 21, further comprising a rotational encoder to generate a signal to couple to the light controller to synchronize the periodic flashing of the plurality of lights with the rotation of the flexible disk.

23. The rotatable light toy of claim 22, wherein the rotational encoder is a magnetic north sensor mounted in the second housing and rotates with the second housing and the flexible disk , the magnetic north sensor to generate the signal each time magnetic north is sensed during rotation thereof.

24. The rotatable light toy of claim 23, wherein the plurality of lights are a plurality of light emitting diodes.

25. The rotatable light toy of claim 23, wherein the light controller is mounted in the second housing, and the rotatable light toy further includes a rotational electrical connection having a first slip ring and a second slip ring to couple power and ground to the light controller, a third slip ring to couple a serial communication signal from the first housing to the light controller in the second housing, and a rotational encoder to generate a rotation encoded signal;

a motor driver circuit coupled to the electric motor, the motor driver circuit to drive the electric motor to rotate the shaft;

a keypad to form user control input for the rotatable light toy; and a keypad/motor controller coupled to the motor driver circuit to control the rotation of the shaft and coupled to the keypad to scan the keypad to receive the user control input and generate the serial communication signal in response thereto to form a user desired pattern of lighting.

26. The rotatable light toy of claim 25, wherein the keypad/motor controller further receives the rotation encoded signal to synchronize the periodic flashing of the plurality of lights with the rotation of the flexible disk to generate the user designed pattern of lighting.

27. The rotatable light toy of claim 26, wherein the user designed pattern of lighting is one or more of text, graphics, and symbols.

28. The rotatable light toy of claim 19, further comprising;

a speaker coupled to the light controller, the speaker to provide sound effects in response to electrical sound signals generated by the light controller.

29. The rotatable light toy of claim 19, wherein the light controller to randomly control the periodic flashing of the plurality of lights on and off to generate a random light pattern when the flexible disk is rotated.

30. The rotatable light toy of claim 19, wherein the light controller to sequentially control the periodic flashing of the plurality of lights as the flexible disk is rotated to generate one or more text messages that are viewed by a human persistence of vision.

31. The rotatable light toy of claim 19, wherein the light controller to sequentially control the periodic flashing of the plurality of lights as the flexible disk is rotated to generate graphics that are viewed by a human persistence of vision.

* * * * *